US011850817B2

(12) United States Patent
Dougherty, Jr.

(10) Patent No.: US 11,850,817 B2
(45) Date of Patent: Dec. 26, 2023

(54) ROTARY TABLET PRESS WITH REMOVABLE TURRET

(71) Applicant: Industrial Pharmaceutical Resources, Inc., Bartlett, IL (US)

(72) Inventor: Joseph I. Dougherty, Jr., Glen Ellyn, IL (US)

(73) Assignee: Industrial Pharmaceutical Resources, Inc., Bartlett, IL (US)

( * ) Notice: Subject to any disclaimer, the term of this patent is extended or adjusted under 35 U.S.C. 154(b) by 253 days.

(21) Appl. No.: 17/326,653

(22) Filed: May 21, 2021

(65) Prior Publication Data

US 2021/0362452 A1 Nov. 25, 2021

Related U.S. Application Data

(60) Provisional application No. 63/029,124, filed on May 22, 2020.

(51) Int. Cl.
*B30B 15/14* (2006.01)
*B30B 15/02* (2006.01)
(Continued)

(52) U.S. Cl.
CPC ..... *B30B 15/028* (2013.01); *B30B 11/085* (2013.01); *B30B 15/0023* (2013.01); *B30B 15/026* (2013.01)

(58) Field of Classification Search
CPC ..... B30B 11/08; B30B 15/0023; B30B 15/08; B30B 15/32; B30B 9/30; B30B 9/301; B30B 9/3032
See application file for complete search history.

(56) References Cited

U.S. PATENT DOCUMENTS 4,601,866 A * 7/1986 David ..... B30B 15/34 425/116
5,253,572 A * 10/1993 Uehara ..... B30B 15/161 100/48
(Continued)

FOREIGN PATENT DOCUMENTS

WO 2011061564 A1 5/2011

OTHER PUBLICATIONS

"ECM-Based Rotary Tablet Presses", GEA Pharma Systems-Courtoy Technologies.

*Primary Examiner* — Thu-Khanh T. Nguyen
(74) *Attorney, Agent, or Firm* — Wood, Phillips, Katz, Clark & Mortimer

(57) ABSTRACT

The rotary tablet press comprises a machine base assembly and detachable module. Granulation is fed into the module from the hopper and travels into the feeder chamber. The base assembly comprises motorized pressure roll assemblies and a turret drive assembly. The detachable module comprises a module base, turret base, turret, cam body, cams, feeder, tablet discharge chute, hopper, upper enclosure, and guard doors. The rotary turret comprises upper punches, dies, and lower punches. As the turret rotates, the dies move underneath the feeder chamber. The rotary feeder paddles move the granulation and assist with feeding powder to the dies. Punches travel along cam tracks as the turret rotates and compresses the powder into a tablet when the punches contact the pressure rolls. An ejection cam pushes the lower punch in the upward direction and a take-off bar mounted just above the die table directs the tablet into a discharge chute. The detachable module is sealed by incorporating an upper enclosure.

20 Claims, 20 Drawing Sheets

(51) Int. Cl.
*B30B 11/08* (2006.01)
*B30B 15/00* (2006.01)

(56) References Cited

U.S. PATENT DOCUMENTS

| | | | | |
|---|---|---|---|---|
| 6,361,302 | B1 | 3/2002 | Hinzpeter et al. | |
| 6,676,863 | B2 | 1/2004 | Christiaens et al. | |
| 6,830,442 | B2 | 12/2004 | Cecil | |
| 8,025,498 | B2 | 9/2011 | Haase et al. | |
| 8,277,707 | B2 | 10/2012 | Waldron | |
| 9,314,946 | B2 | 4/2016 | Pannewitz | |
| 9,840,055 | B2 | 12/2017 | Janke et al. | |
| 10,052,836 | B2 | 8/2018 | Vogeleer et al. | |
| 10,449,119 | B2 | 10/2019 | Scheffler et al. | |
| 2010/0221374 | A1* | 9/2010 | Le Floc'h | B05B 13/0257 118/56 |
| 2011/0012283 | A1 | 1/2011 | Waldron | |
| 2016/0361885 | A1 | 12/2016 | Oyama et al. | |
| 2018/0178474 | A1* | 6/2018 | Vogeleer | B30B 15/0023 |

* cited by examiner

ROTARY TABLET PRESS WITH REMOVABLE TURRET

CROSS-REFERENCE TO RELATED APPLICATIONS

This application claims priority of Provisional Ser. No. 63/029,124 filed May 22, 2020, the disclosure of which is hereby incorporated by reference in its entirety.

FIELD OF THE INVENTION

This invention relates to rotary tablet presses and, more particularly to a removeable turret module.

BACKGROUND OF THE INVENTION

Oral dosage medication is typically manufactured by directly compressing granulation on a rotary tablet press. Tooling is used on the tablet press to identify and produce specific products. The tooling consists of an upper punch, lower punch, and a die. To form a tablet, granulated powder material must be fed into a cavity formed by two punches and a die. The punches are pressed together with sufficient force to fuse the powder into a tablet.

All granulations are abrasive and due to the force at compaction, tools wear out and must be replaced. Maintaining quality tooling is essential to product consistency. Cleaning is also frequently required.

In a rotary tablet press, a turret is rotatable about a vertical axis and carries a plurality of dies. Each die has associated top and bottom punches driven by top and bottom cams to compress the granulation into a tablet. For cleaning between batches or changeover for a different tablet, the turret with punches and cams is removable as a unit from the tablet press.

Such rotary tablet presses are provided by various manufacturers and described, for example, in U.S. Pat. Nos. 4,988,275 and 6,676,863 and EP1050399.

Prior art removable turret press designs incorporate a single press frame for structural support of the turret and pressure roll assemblies. These designs prevent the removal of the turret along with the machine base on which it is supported. These designs generally require an operator to disconnect, move and/or remove several components including removing a heavy turret and loading it onto an ancillary cart in order to change the press to a different tooling size or configuration such as bi-layer or tri-layer. These designs also constrain the tablet press to only utilize turrets having the same diameter and height dimensions. Prior art designs require cleaning and great care in transferring the equipment to a cleaning room without risk of cross contamination. Prior art presses with removable or detachable turrets incorporate mechanisms that attach to and drive the turret from beneath. This not only requires an ancillary cart but also the requirement to disconnect, move and/or remove press components and lift and load the turret.

The present invention is directed to improvements in design of a removable turret.

SUMMARY OF THE INVENTION

An object of the present invention is to provide a tablet press that is more configurable and flexible for tablet manufacturers, requires less time for changeover between batches, and contains dust generated during the tableting operation to minimize exposure to the operator. This is accomplished by housing the compression roll assemblies and turret assembly in two separate and distinct support structures that can be connected to one another and operate in unison as a tablet press.

In view of this objective, the press is divided into two primary assemblies herein referred to as the base assembly and detachable turret module. The base assembly incorporates motorized pressure roll assemblies that may move both linearly and axially. Having linear movement, the pressure rolls are automatically moved into a position, if necessary, to allow the turret module to be detached and removed from the base assembly without interference. The movement, if necessary, allows the compression assemblies housed in the base assembly to adjust tablet thickness during operation and to be configured for various turret modules containing turrets with different physical dimensions during setup.

In accordance with one aspect of the invention, a rotary tablet press comprises a base assembly comprising a press housing and a compression assembly in the press housing including pressure roll assemblies. A detachable module is removably mountable to the base assembly comprising a module base supporting a turret housing. A turret assembly is rotatably mounted in the turret housing about a vertical axis. The turret assembly comprises a plurality of die stations. The detachable module is selectively positioned at the base assembly so that the pressure roll assemblies engage the turret assembly to compress a granulation into a tablet at the die stations. A turret drive assembly comprises a turret motor and drive shaft. The drive shaft is aligned with the vertical axis and engaging the turret assembly to rotate the turret assembly.

In accordance with another aspect of the invention, a rotary tablet press comprises a press housing having bottom and top ends, the bottom for resting on a support surface. A compression assembly in the press housing and including pressure roll assemblies. A drive housing extends outwardly from the top end of the press housing. A drive assembly in the drive housing comprises a turret motor and drive shaft extending downward from the turret motor. A turret assembly comprises a plurality of die stations. The turret assembly is mounted to the turret housing about a vertical axis so that the pressure roll assemblies engage the turret assembly to compress a granulation into a tablet at the die stations. The drive shaft is aligned with the vertical axis and engages the turret assembly to rotate the turret assembly.

Further features will be readily apparent from the specification and from the drawings.

DETAILED DESCRIPTION OF THE INVENTION

Figure 1:
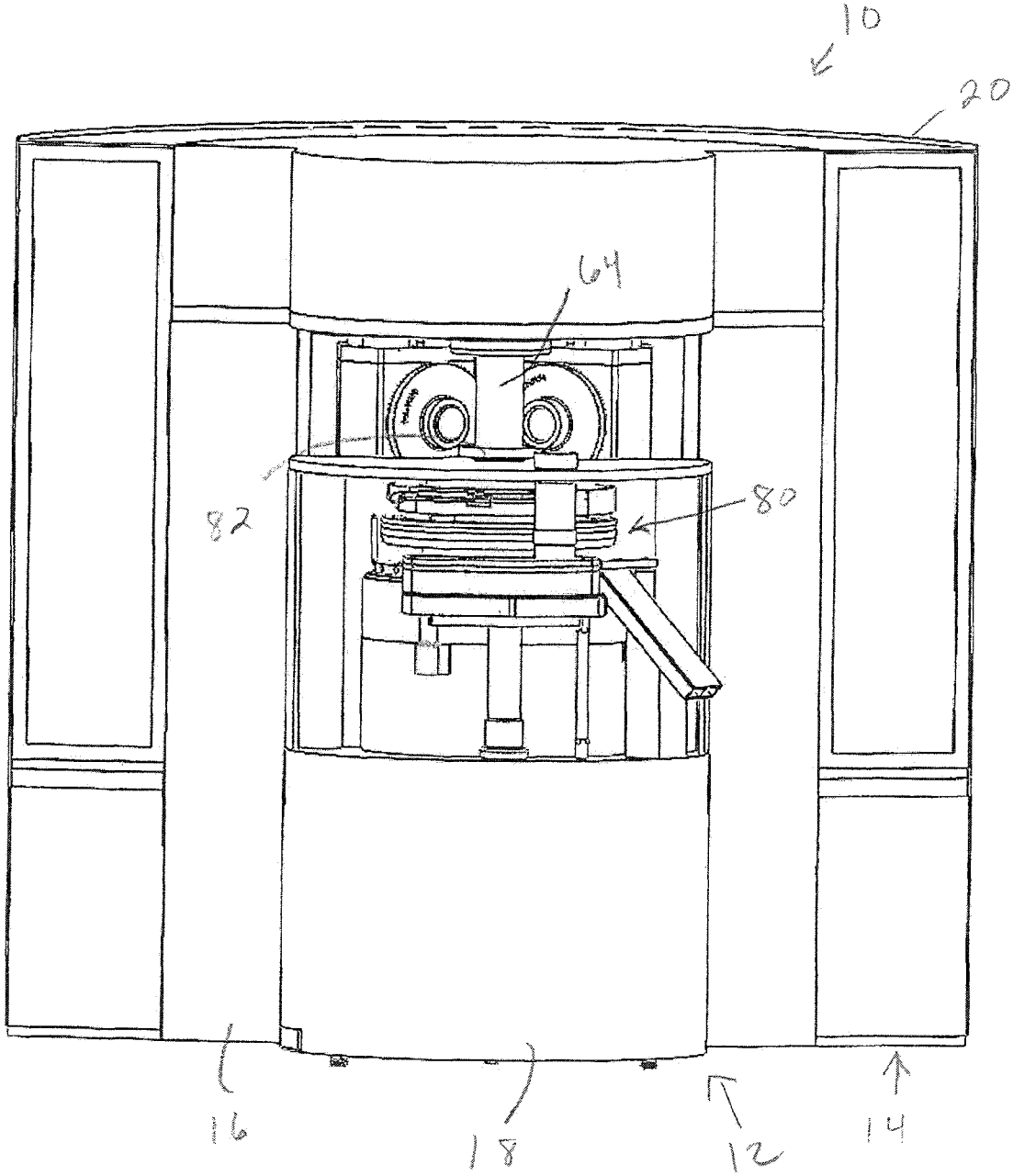
FIG. 1 is a perspective view of a rotary tablet press machine in accordance with the invention comprising a press assembly and a control cabinet.

The present invention relates to a rotary tablet press comprising a base assembly or machine frame and detachable module. The base assembly comprises motorized pressure roll assemblies and optionally a turret drive assembly. The detachable module comprises a module base, turret base, turret, cam body, cams, feeder, tablet discharge chute, hopper, upper enclosure, and guard doors. The detachable module could also incorporate pressure roll assemblies for bilayer or trilayer applications. The turret comprises chambers arranged circumferentially to hold upper punches, lower punches, and dies. As the turret rotates, punches follow a cam track and reciprocate into and out of dies that receive granulation as they are rotated under the feeder. A tablet is formed when the punches contact the pressure rolls causing compaction of the granulation in the die.

The disclosed tablet press is more configurable and flexible for tablet manufacturers, requires less time for changeover between batches, and contains dust generated during the tableting operation to minimize exposure to the operator. This is accomplished by housing the compression roll assemblies and turret assembly in two separate and distinct support structures that can be connected to one another and operate in unison as a tablet press.

The press is divided into two primary assemblies herein referred to as the base assembly and detachable turret module. The base assembly incorporates motorized pressure roll assemblies that move both linearly and axially. Having linear movement, the pressure rolls are automatically moved into a position, if necessary, to allow the turret module to be detached and removed from the press frame without interference. The axial movement allows the compression assemblies housed in the base assembly to adjust tablet thickness during operation and to be configured for various turret modules containing turrets with different physical dimensions.

The press frame may incorporate the turret drive mechanisms that enable the drive shaft to be mounted above the turret. This frees up space in the module below the turret for incorporating vacuum, cleaning features, or used for other requirements. Additionally, the module cost and weight are reduced by not having to incorporate the drive motor and assembly in the module.

Isolating and housing the control components in the frame avoids the requirement for calibration of pressure roll positions, load cells or strain gages, and turret speed when a module is detached or attached.

A precision pneumatic, hydraulic, magnetic, physical connection, or other method is incorporated to secure the turret module to the base assembly. Alignment and mounting are designed to ensure the module can be precisely detached and attached to the frame without impacting the machine performance.

The detachable module comprising of a module base, turret base, turret, cam body, cams, feeder, tablet discharge chute, hopper, upper enclosure, and guard doors eliminates the requirement for an external cart and significantly reduces the changeover time. An operator simply disconnects the powder inlet connection, presses a detach module button in the tablet press HMI software, disconnects cable connector(s), and uses a pallet truck, automated guided vehicle, or other appropriate material handling mechanism to remove the module in a matter of minutes.

The illustrated and described rotary press machine improves upon the prior art tablet presses by isolating the pressure roll assemblies in a separate and distinct base assembly from a detachable turret module comprising of a turret and the base on which it is supported to provide a faster, more configurable, and safer solution for the customer and eliminating the need to lift and remove a heavy turret unit and load it onto an ancillary cart. Sealing the module minimizes the operator's exposure to granulation dust particles and enables the module to be transferred to a cleaning room with less risk of cross contamination. Prior art presses incorporate mechanisms that attach to and drive the turret from beneath. Having a detachable module that incorporates the turret supporting base eliminates the requirement for an ancillary cart as well as the requirement to disconnect, move and/or remove press components and lift and load the compression unit and/or turret.

Referring initially to FIG. 1 a rotary tablet press machine 10 in accordance with the invention is illustrated. The rotary tablet press machine 10 comprises a press assembly 12 and a control cabinet 14. The press assembly 12 comprises a base assembly 16 and a removeable/detachable module 18, see also FIG. 2.

Although not shown in detail herein, the control cabinet 14 comprises an arcuate shaped housing 20 which wraps around the press assembly 12. The control cabinet 14 includes space for control components and operator displays, none of which are shown and do not themselves form part of the invention. Provision is also made for providing necessary electrical connections between control devices in the control cabinet 14 and the press assembly 12.

In accordance with the invention, the press assembly 12 is designed to isolate the turret drive assembly and pressure roll assemblies, described below, in the base assembly 16 from the detachable module 18 to provide a faster, more configurable, and safer solution for the customer. Having a detachable module 18 that incorporates the turret supporting base, described below, eliminates the requirement for an ancillary cart as well as the requirement to disconnect, move and/or remove press components and to lift and load the compression unit and/or turret.

Figure 3:
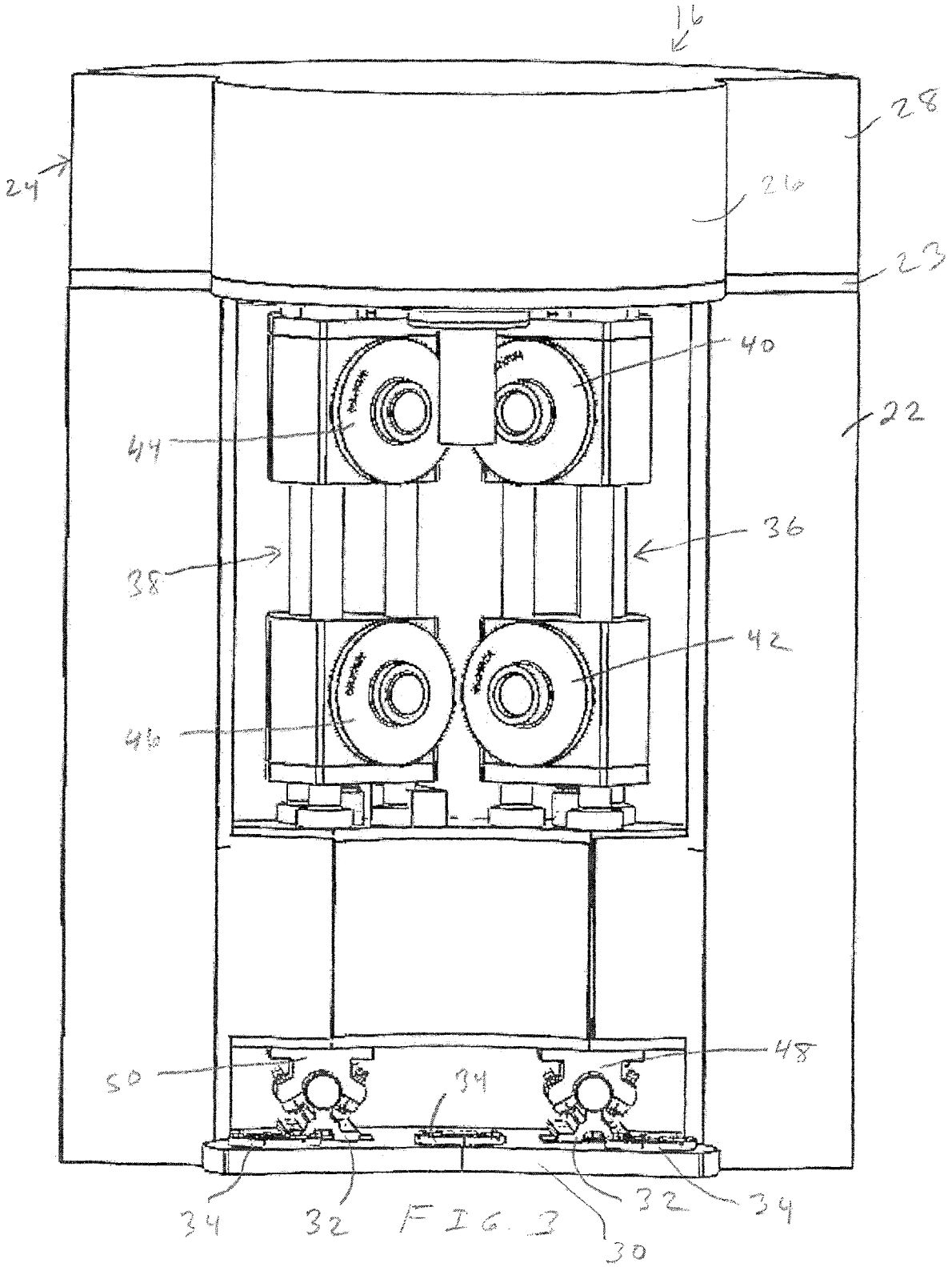
FIG. 3 is a perspective view of the base assembly of FIG. 2 with parts removed to illustrate pressure roller assemblies.
Figure 4:
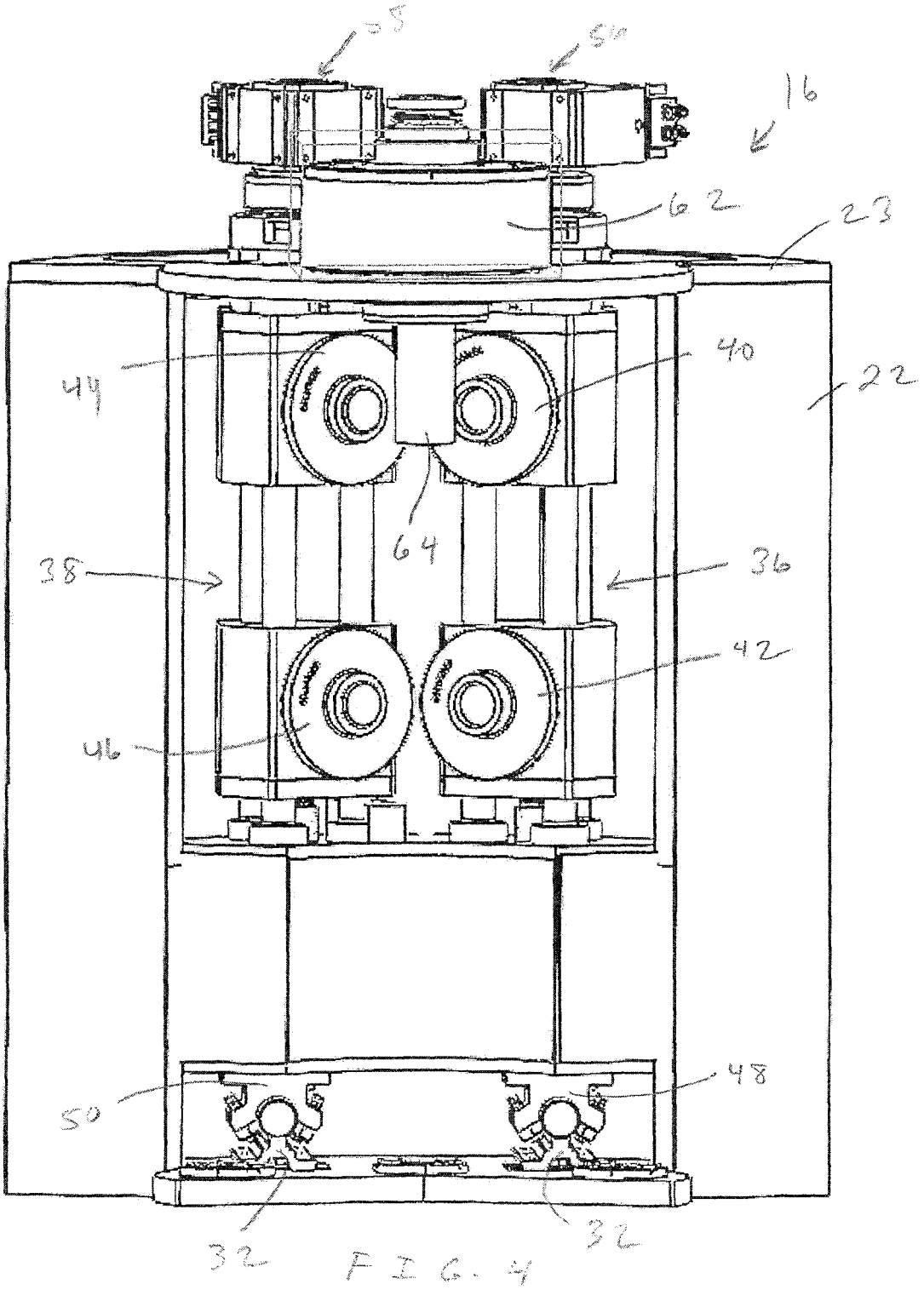
FIG. 4 is a perspective view of the base assembly of FIG. 3 with a top cover removed to illustrate a drive system.

Referring to FIGS. 3 and 4, the base assembly 16 comprises an arcuate shaped press housing 22 adapted to fit within the control cabinet 14 FIG. 1. A top wall 23 is at the top of the press housing 22. A top cover 24 overlays the top wall 23 and includes a circular roof enclosure 26 surrounded by an arcuate roof enclosure 28. A generally semi-circular bottom wall 30 extends forwardly of the bottom of the press housing 22 and is aligned with the circular roof enclosure 26. The bottom wall 30 includes two parallel rails 32 and three female stud plates 34, see also FIG. 8.

In the embodiment of FIG. 3, the press housing 22 houses two motorized pressure roll assemblies 36 and 38. Some designs may use a single pressure roll assembly. The first roller assembly 36 has an upper roller 40 and a lower roller 42. The second roller assembly 38 has an upper roller 44 and a lower roller 46. The rollers 40 and 42 are in a plane perpendicular to that of the rollers 44 and 46. The roller assemblies 36 and 38 are supported on linear guides 48 and 50 moveable on the rails 32 by respective drives (not shown) to move the roller assemblies 36 and 38 forward and back. As is apparent, the rails 32 could be eliminated, or may be configured to move the roller assemblies 36 and 38 laterally, as necessary and desired. The roller assemblies 36 and 38 are driven by upper drives 56 and 58. Particularly, the drive 56 operates to move the rollers 40 and 42 towards or away from one another to engage or disengage a turret during operation. Similarly, the drive 58 operates to move the rollers 44 and 46 towards or away from one another.

The top wall 23 is mounted atop the press housing 22 and is of a shape corresponding to the cover 24, discussed above. The top wall 23 supports a turret drive torque motor 62 which drives a downwardly depending drive shaft 64. The motor 62 is also configured to raise and lower the drive shaft 64 to engage a turret for rotation therewith.

Figure 5:
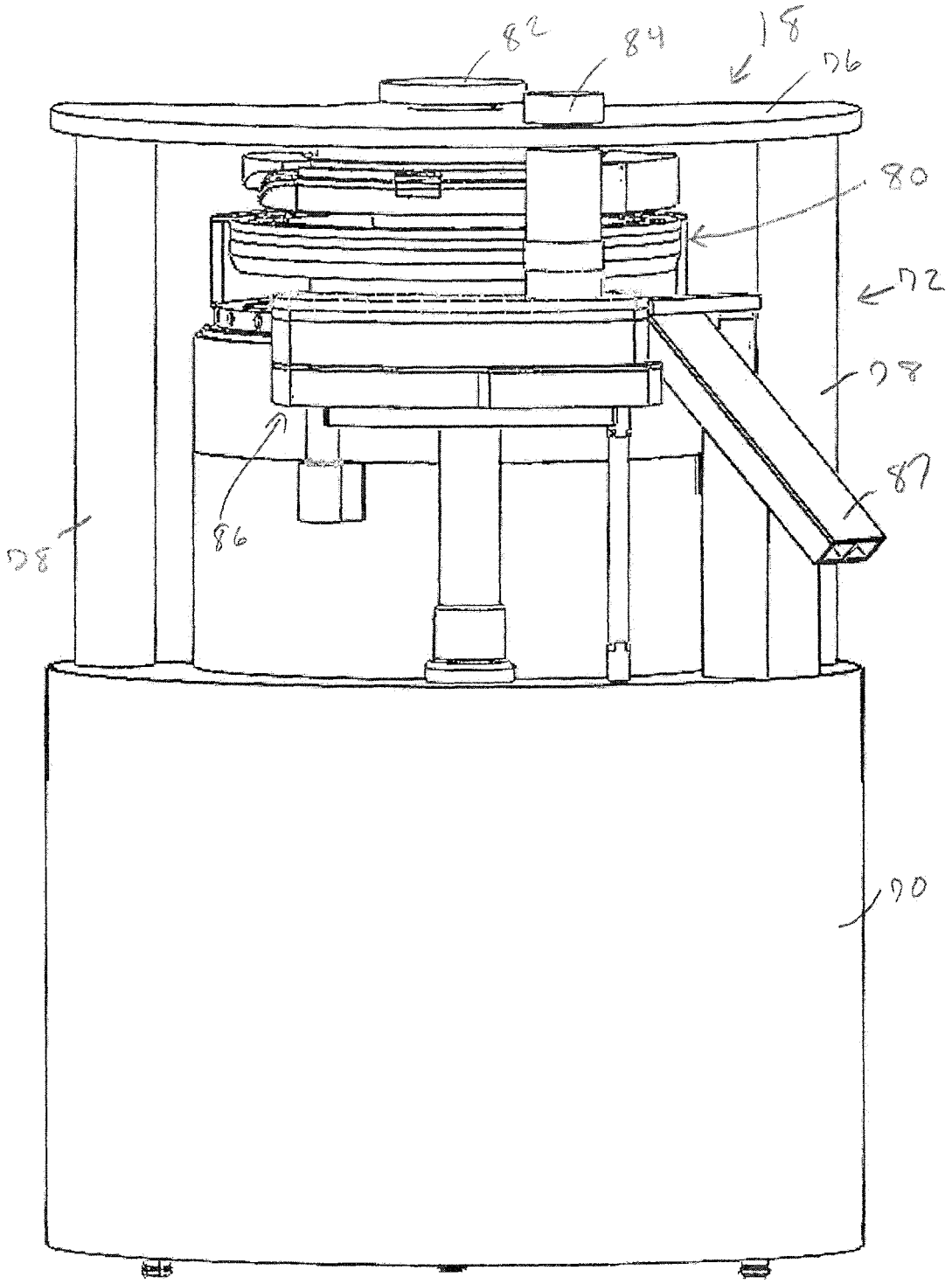
FIG. 5 is a front perspective view of the turret module of FIG. 2.
Figure 6:
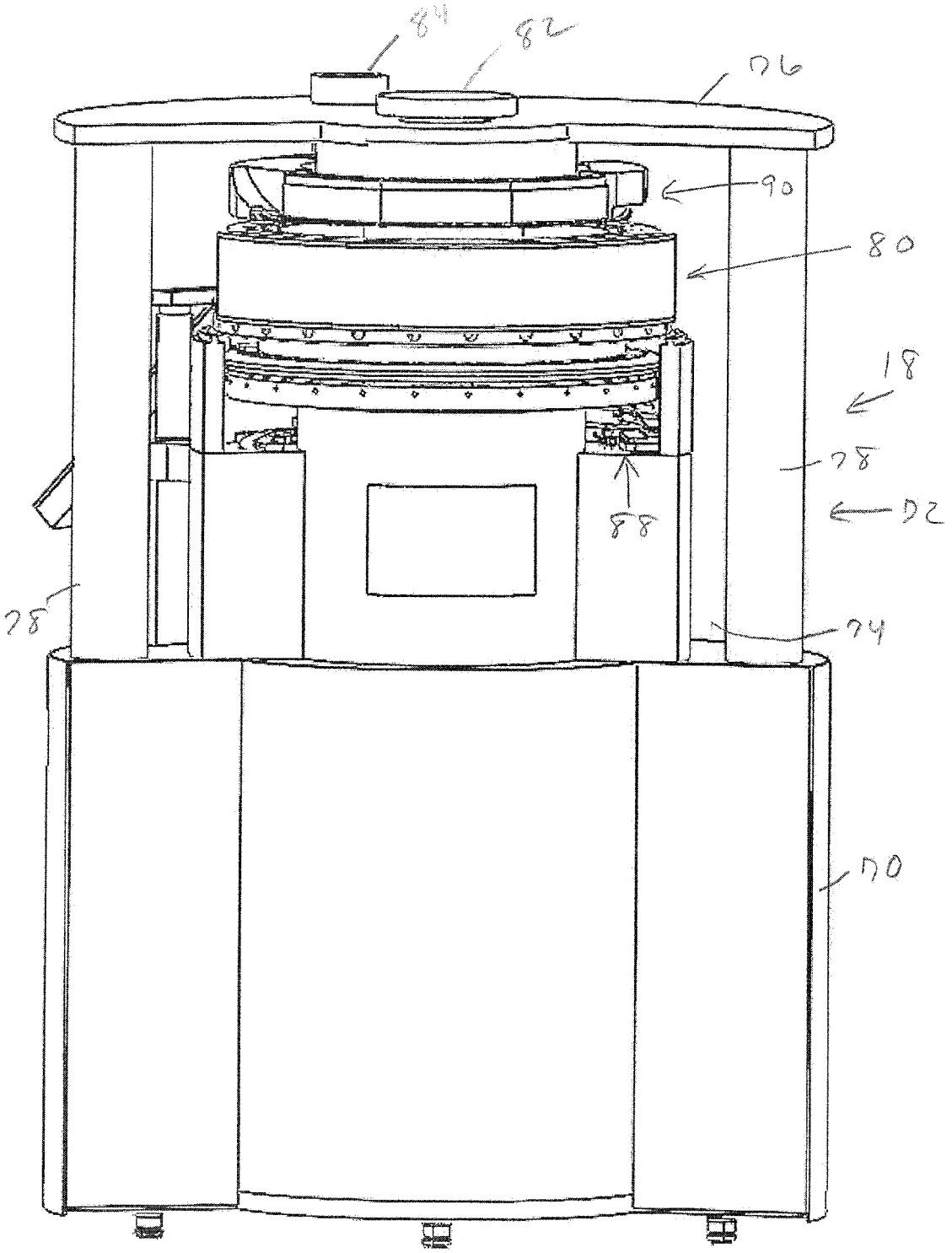
FIG. 6 is a rear perspective view of the turret module of FIG. 2.
Figure 7:
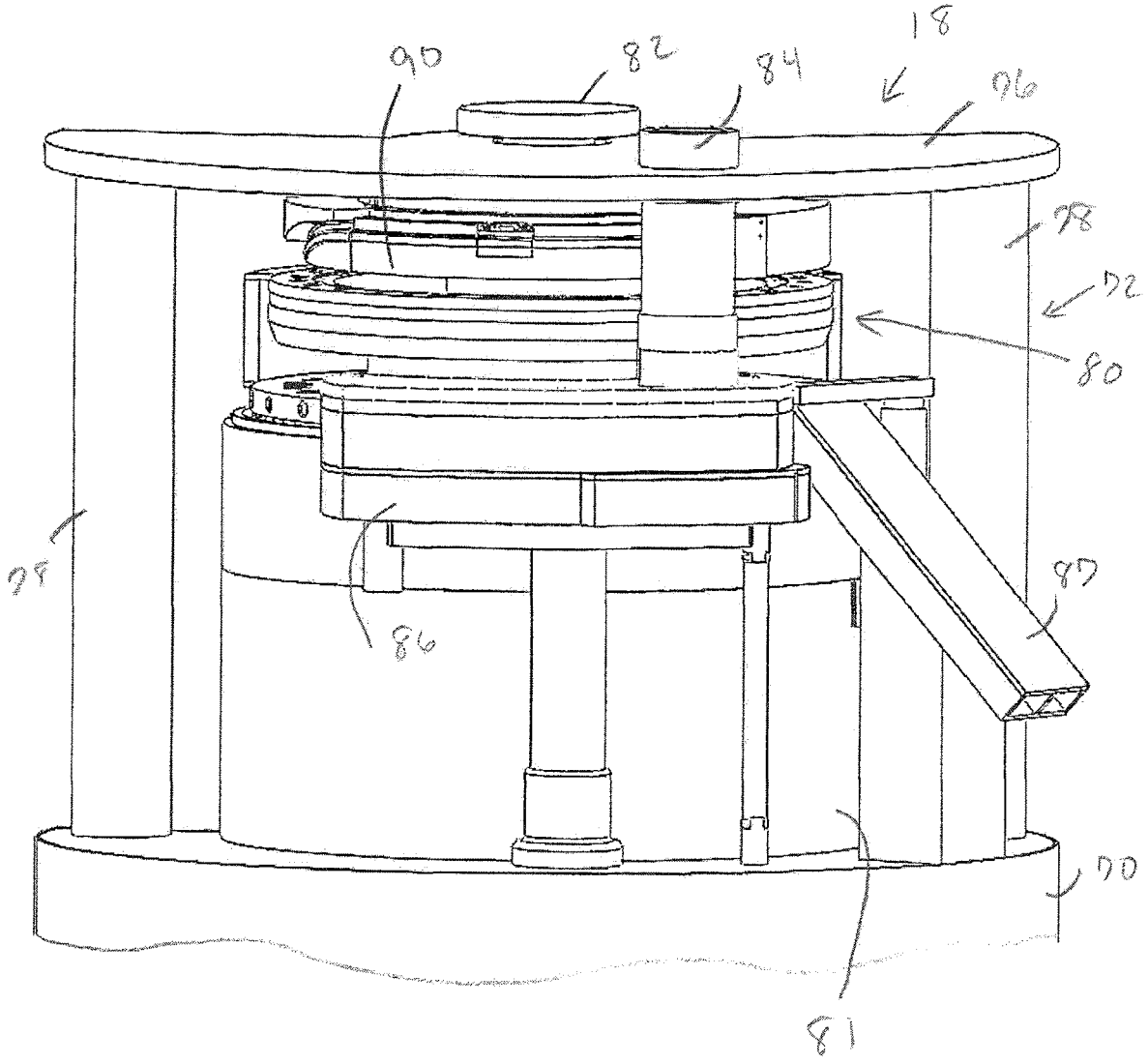
FIG. 7 is a detailed front perspective view of the turret housing of the module of FIG. 5.

Referring to FIGS. 5 and 6, the detachable module 18 is of a generally semi-circular shape, adapted to be received in the base assembly 16 in FIG. 3 to provide a generally cylindrical configuration surrounded by a partial peripheral extension, as shown.

The module 18 comprises a module base 70 supporting a turret housing 72. The turret housing 72 has a top wall 76 supported on pillars 78 which are in turn supported on the module base 70. A transparent outer wall 74, omitted for clarity in FIG. 5, surrounds the front of the turret housing 72 to isolate the internal assemblies. The outer wall 74 may be of a clear polycarbonate material. When the detachable module 18 is secured to the base assembly, the detachable module 18 is sealed by incorporating an upper enclosure via the outer wall 74. The back of the turret housing 72 is open to allow the pressure roll assemblies 36 and 38 to engage the upper and lower punches, as described below.

In a rotary tablet press, a turret is rotatable about a vertical axis and carries a plurality of dies. Each die has associated top and bottom punches driven by top and bottom cams to compress the granulation into a tablet. An upper punch, a lower punch and a die are together referred to as a station. This is discussed below relative to FIG. 11.

The turret housing 72 encloses a turret assembly 80. The turret assembly 80 is mounted to a support 81 which is in turn supported on the module base 70. The turret assembly 80 is rotatable relative to the support 81. The turret assembly 80 typically includes a die table and upper punch guide and lower punch guide assemblies. The turret module 18 houses the turret assembly 80 along with a cam body, cams, feeder, tablet discharge chute, and a hopper. Although not shown in detail, the turret assembly 80 comprises chambers arranged circumferentially to hold upper punches, lower punches, and dies. As the turret assembly 80 rotates, punches follow a cam track and reciprocate into and out of dies that receive granulation as they are rotated under the feeder, as is conventional. A tablet is formed when the punches contact the pressure rolls 40, 42, 44 and 46 in FIG. 3, discussed above, causing compaction of the granulation in the die. This general operation is conventional, and the exact configuration will depend, in part, on the tablet being manufactured. The invention herein is particularly directed to the use of the detachable and removable module 18. This isolates the turret drive, compression assembly, and controls from the turret, feeder, hopper, chute, cams, and module base. Current presses have removable components (i.e. turret, columns). The removable module feature is unique by creating a quick disconnect for faster changeover providing increased flexibility and versatility for changeover to different tooling sizes and/or turret sizes and configuration for bilayer and trilayer tableting, improved ease of cleaning and containment, and it eliminates impact of calibration when moving the press. Also, the turret top drive 62 in FIG. 4 moves the drive system for the turret to the top of the press.

Figure 2:
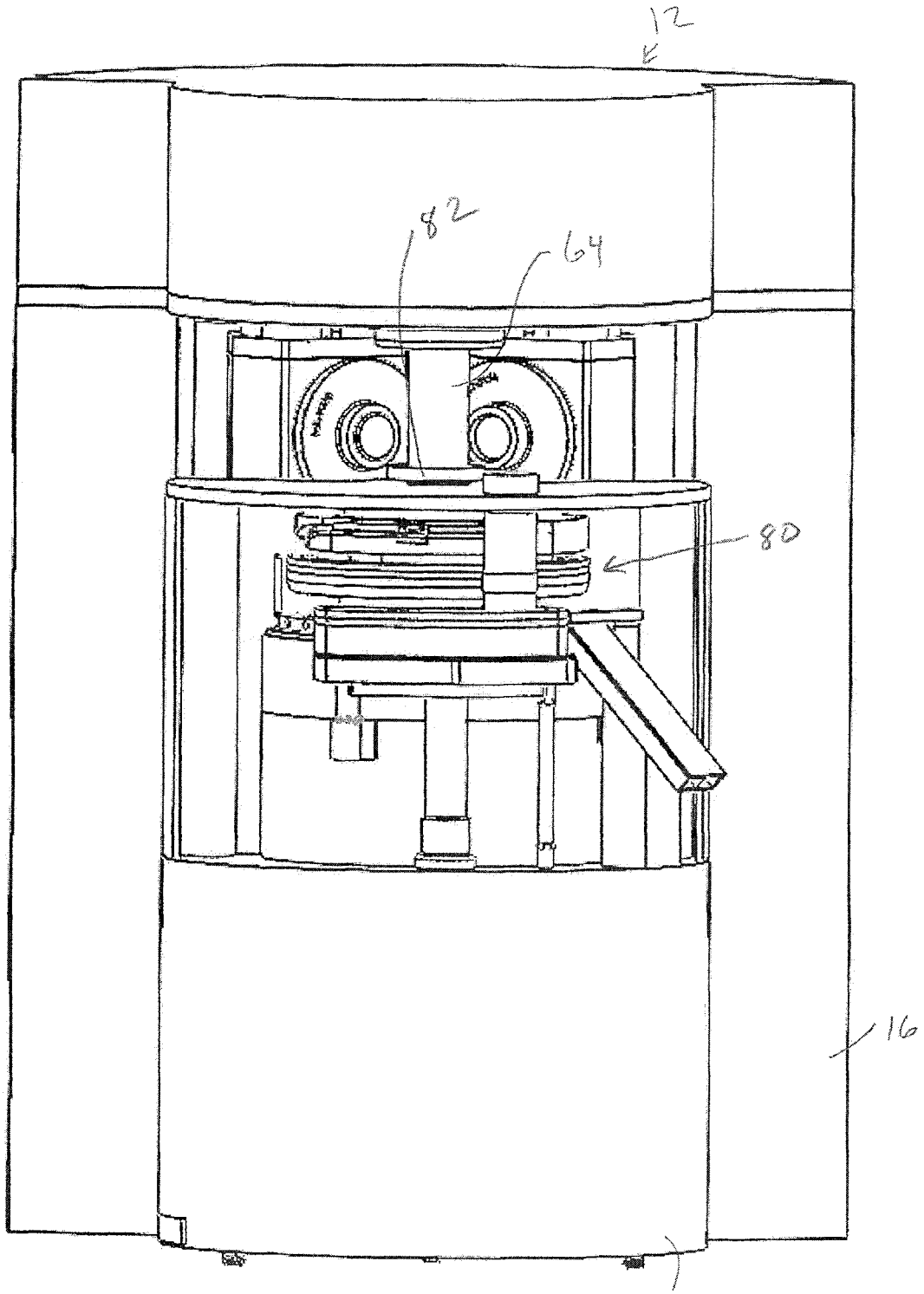
FIG. 2 is a perspective view of the press assembly of FIG. 1 comprising a base assembly and a detachable turret module.

In accordance with the invention, the turret assembly 80 is driven by an inlet coupling 82 on the top wall 76 engageable by the drive shaft 64, see FIGS. 1 and 2, for driving the turret assembly 80 from above. A powder inlet 84 is provided in the top wall 76 for providing granulated powder to a feeder assembly 86. The feeder assembly 86 is driven by a feeder motor, not shown, to feed powder to the dies. A tablet take-off (not shown) guides the tablet as it is ejected from the die into a discharge chute 87.

Figure 8:
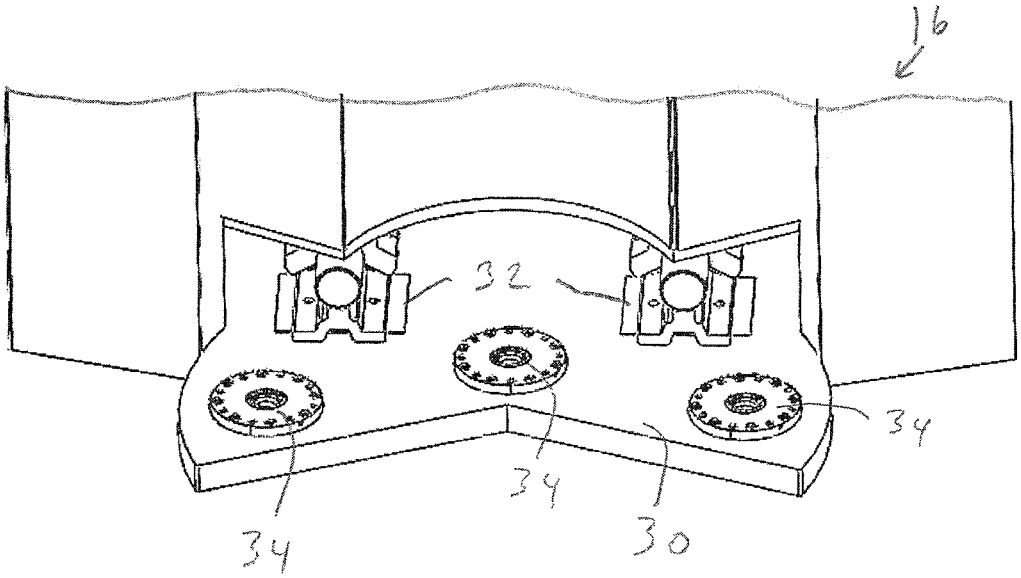
FIG. 8 is front perspective view of the bottom of the base assembly and FIG. 9 is a bottom perspective view of the turret module together illustrating connection components for mounting the turret module to the base assembly.
Figure 9:
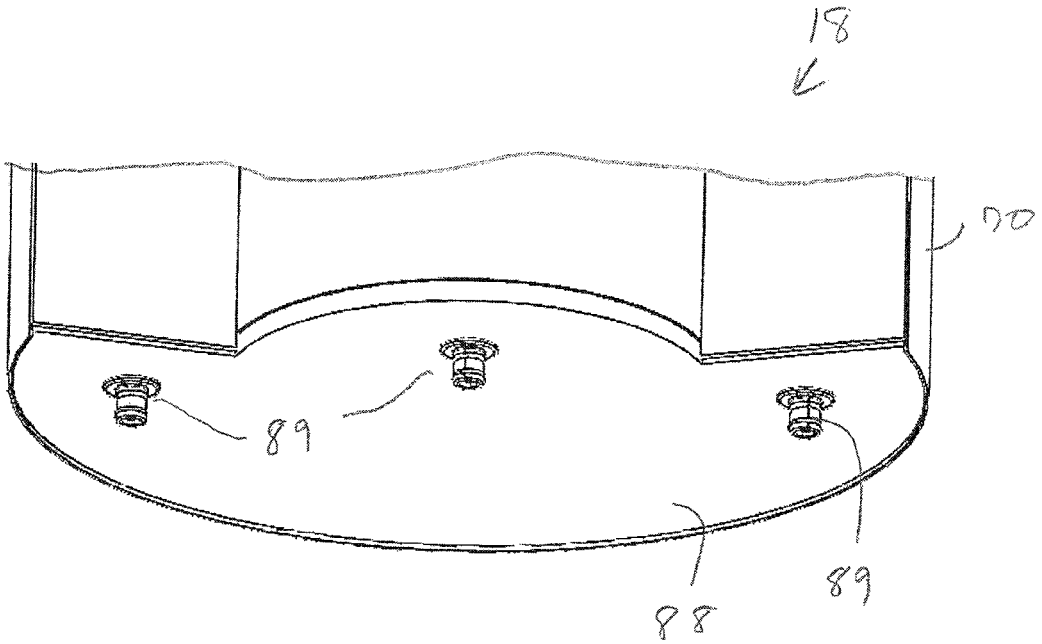

Referring to FIGS. 8 and 9, the module base 70 has a bottom wall 88 with three downwardly depending studs 89. The studs 89 are aligned to be selectively received in the female stud plates 34 incident to the detachable module 18 being positioned proximate the base assembly 16. This may be done with a forklift or the like to lower the turret module 18 onto the base assembly bottom wall 30 with the studs 89 received in the stud plates 34. Other structure not shown is used to secure the turret module 18 to the base assembly 16 and to seal and isolate the turret housing 72 from the exterior. With the module 18 positioned with the base assembly 16, as shown in FIGS. 1-3, the rollers 40, 42, 44 and 46 shown in FIG. 3, are positioned relative to the module 18 to engage the turret assembly 80 and contact punches, not shown, to compress the granulated powder to form a tablet, in a conventional manner.

Figure 10:
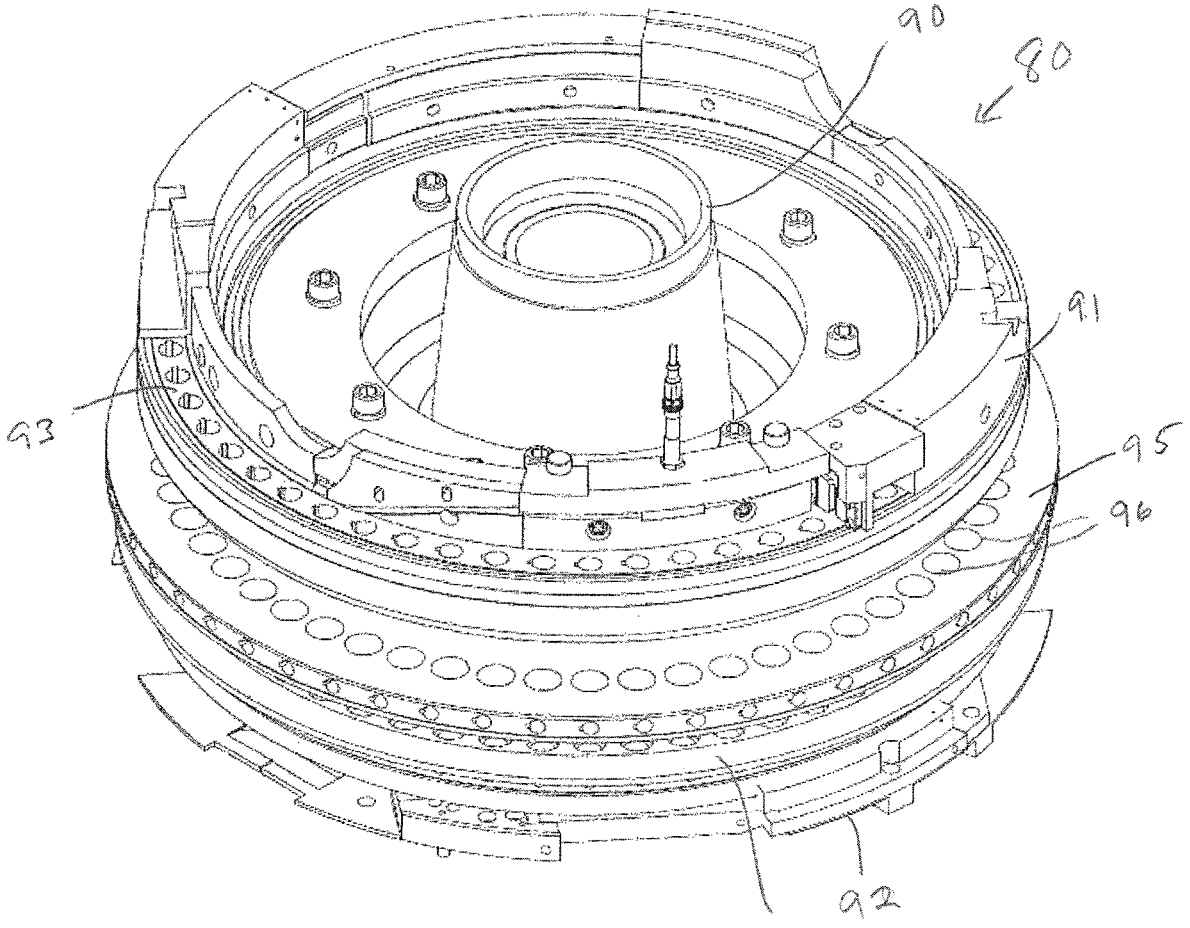
FIG. 10 is a perspective view of an exemplary turret assembly.

FIG. 10 illustrates an exemplary turret assembly 80. The turret assembly 80 includes an upper cam body 90 which is driven by the drive shaft 28. An upper cam track assembly 91, lower cam track assembly 92, an upper turret section 93 (for upper punches), a lower turret section 94 (for lower punches) and a die table 95 are operatively secured to the upper cam body 90 to be rotated therewith. The upper punches (not shown) are operated by the upper cam track assembly 91 in a conventional manner. The lower punches (not shown) are operated by the lower cam track assembly 92 in a conventional manner. The die table 95 includes plural openings 96 each for receiving a die (not shown). As the turret assembly 80 rotates, the punches follow the respective cam tracks 91 and 92 and reciprocate relative to the dies. Each die receives granulation as they are rotated under the feeder assembly 86. A tablet is formed when the punches contact the upper rollers 40 and 44 and the lower rollers 42 and 46, as is known, causing compaction of the granulation in the die. The upper punches are then raised by the upper cam track 91 and ejected by the lower cam track 92 causing the lower punches to be raised. This general operation is conventional, and the exact configuration will depend, in part, on the tablet being manufactured.

In accordance with the invention, a manufacturer may have a plurality of different turret modules for use with a single base assembly 16. Each module can have a different turret assembly and appurtenances depending on the type of tablet to be produced. There will be at least four total configurations for this machine design utilizing a base assembly with compression and drive assemblies with a removable module including a turret, feeder, and cam module assembly. Each will offer different turret confurations. Also, different configurations of the base assembly 16 may be provided with different number and configuration of compression roller assemblies, as discussed below.

For example, the rotary tablet press in accordance with the invention may be configured to be Single Layer & Single Sided (one feeder, one product); Single Layer & Double Sided (two feeders, two products); Bilayer (two feeders, one product); and Trilayer (three feeders, one product). A single sided press has only one feeder, and it is designed to make a single layer tablet. It is designed with two equal size compression assemblies for pre-compression and main compression. A triple sided press has three feeders, and it is designed to make a triple layer containing three different granulations. It is design with one large compression assembly for main compression.

Figure 11:
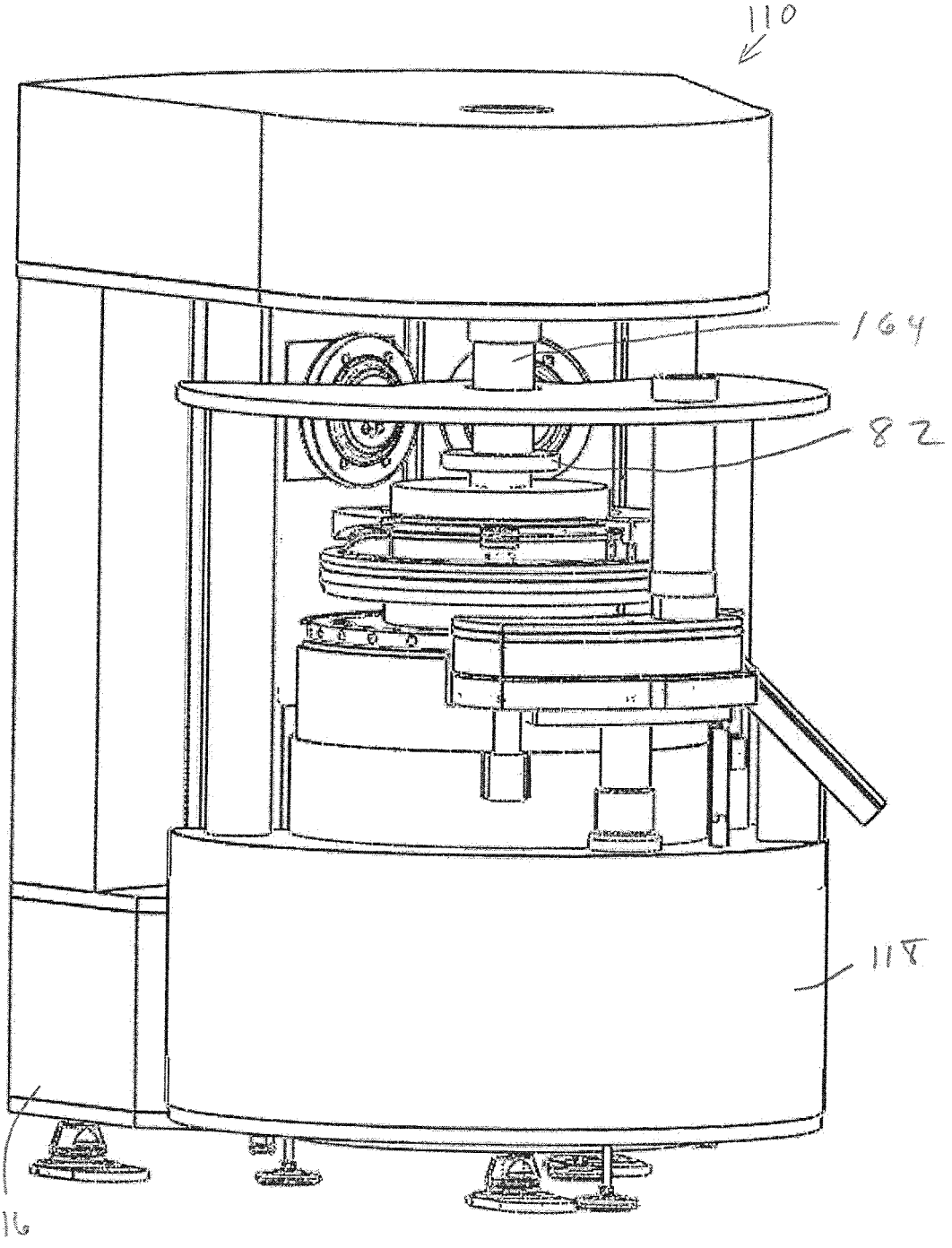
FIG. 11 is a perspective view of a rotary tablet press machine in accordance with a second embodiment of the invention comprising a base assembly and detachable turret module.
Figure 12:
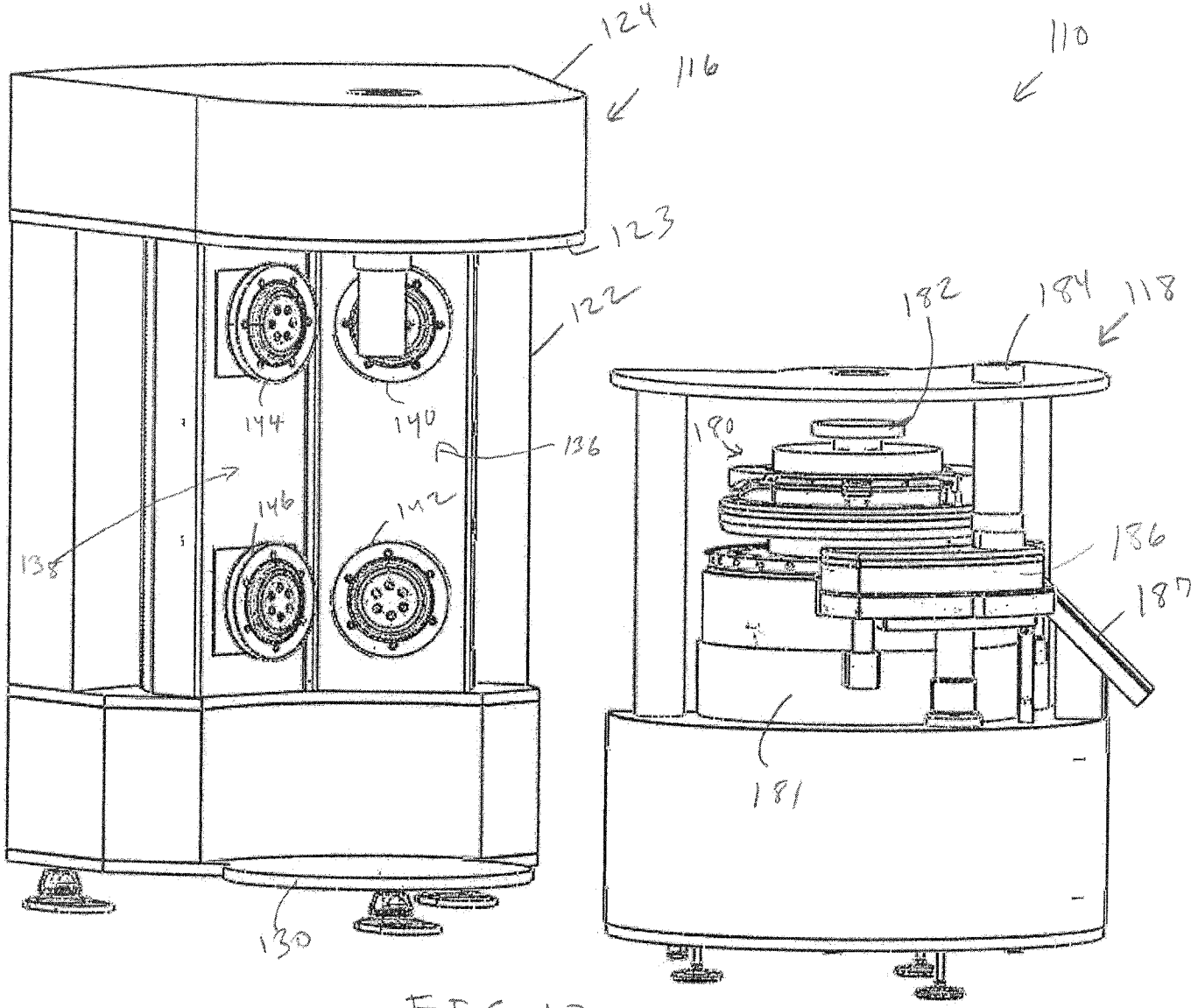
FIG. 12 is a perspective view of the turret module of FIG. 11 separated from the base assembly.

FIGS. 11-14 illustrate a rotary tablet press 110 in accordance with another embodiment of the invention is illustrated. The rotary tablet press 110 is similar to that of FIG. 1 in operation. For simplicity, the reference numerals in this embodiment correspond to those in the embodiment of FIG. 1 except for being in the one hundred series. The rotary tablet press 110 has a smaller footprint by eliminating the separate control cabinet of the embodiment of FIG. 1. The press 110 comprises a base assembly 116 and a removeable/detachable turret module 118, see also FIG. 12. FIG. 12 illustrates the turret module 118 separated from the base assembly 116. The base assembly 116 includes space for control components and operator displays, none of which are shown and do not themselves form part of the invention.

Figure 13:
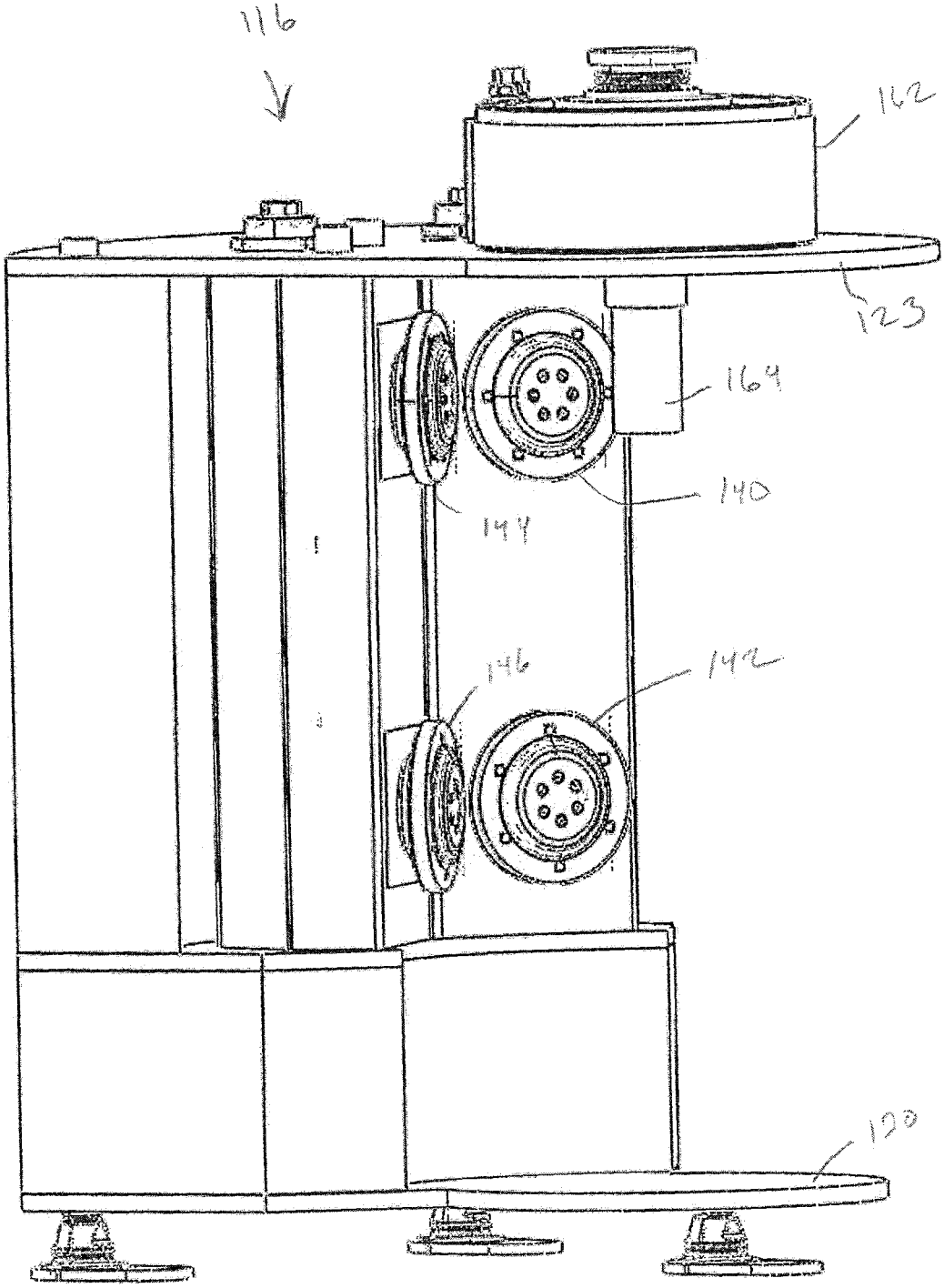
FIG. 13 is a perspective view of the base assembly of FIG. 11.

Referring to FIGS. 12 and 13, the base assembly 116 comprises an arcuate shaped press housing 122. A top wall 123 is at the top of the press housing 122. A top cover 124 overlays the top wall 123. A generally semi-circular bottom wall 130 extends forwardly of the bottom of the press housing 122 and is aligned with the top wall 123. Although not shown the bottom wall 130 may include female stud plates for mounting the turret module, as above.

The press housing 122 includes two motorized pressure roll assemblies within the housing 122 as well as rails and mounting structure details of which are not shown. Reference may be made to the embodiment of FIG. 3 for such elements. A first roller assembly 136 has an upper roller 140 and a lower roller 142. A second roller assembly 138 has an upper roller 144 and a lower roller 146. The rollers 140 and 142 are in a plane perpendicular to that of the rollers 144 and 146.

The top wall 123 is mounted atop the press housing 122 and is of a shape corresponding to the cover 124, discussed above. The top wall 123 supports a turret drive torque motor 162 which drives a downwardly depending drive shaft 164. The motor 162 is also configured to raise and lower the drive shaft 164 to engage a turret for rotation therewith.

Figure 14:
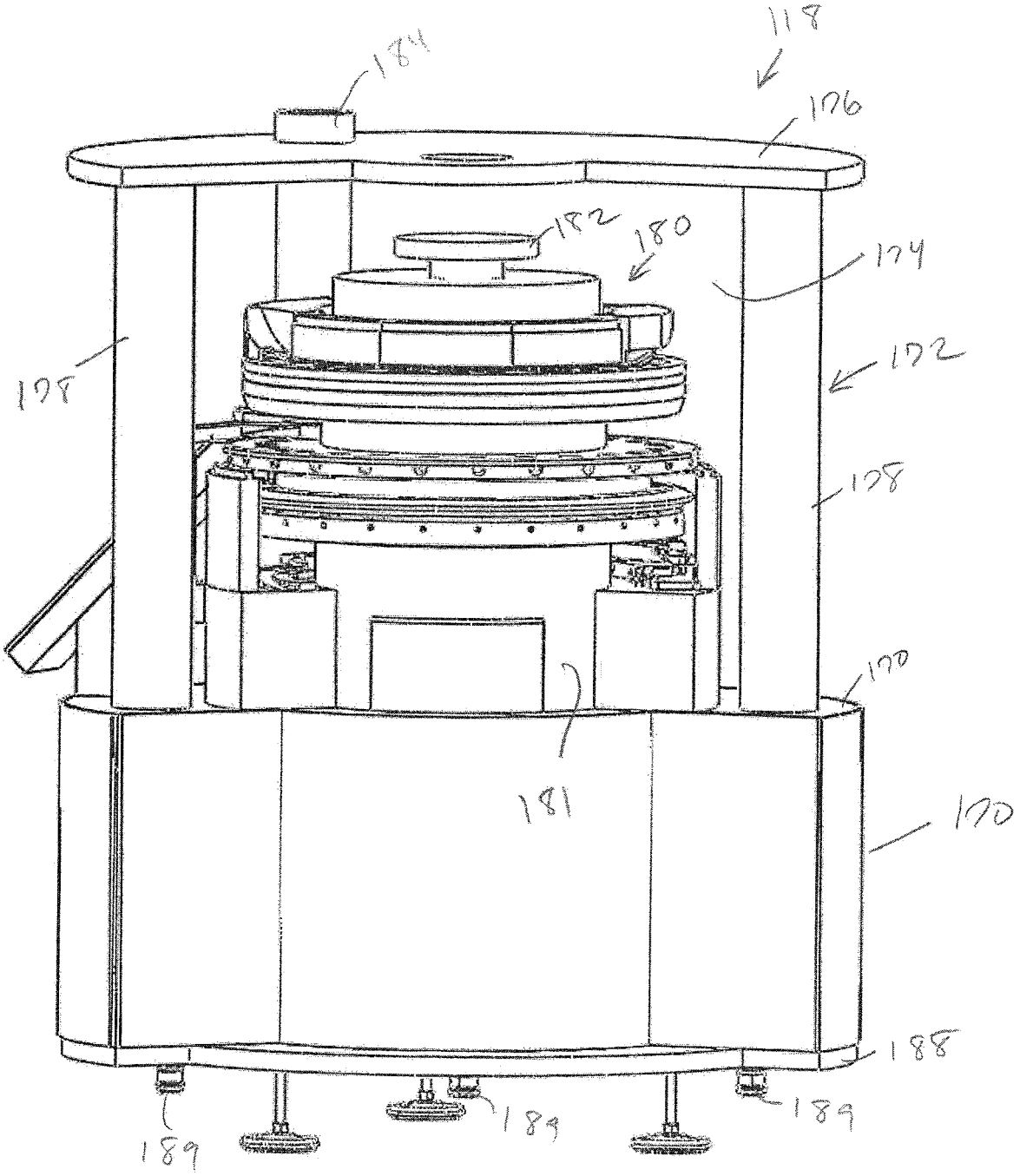
FIG. 14 is a rear perspective view of the turret module of FIG. 11.

Referring to FIGS. 12 and 14, the detachable module 118 is of a generally semi-circular shape, adapted to be received in the base assembly 116 in FIG. 11 to provide a generally cylindrical configuration surrounded by a partial peripheral extension, as shown.

The module 118 comprises a module base 170 supporting a turret housing 172. The turret housing 172 has a top wall 176 supported on pillars 178 which are in turn supported on the module base 170. A transparent outer wall 174, omitted for clarity in FIG. 12, surrounds the front of the turret housing 172 to isolate the internal assemblies. The outer wall 174 may be of a clear polycarbonate material. When the detachable module 118 is secured to the base assembly 116, the detachable module 118 is sealed by incorporating an upper enclosure via the outer wall 174. The back of the turret housing 172 is open to allow the pressure roll assemblies 136 and 138 to engage the upper and lower punches in the turret, as described below.

The turret housing 172 encloses a turret assembly 180, as above. The turret assembly 180 is mounted to a turret support 181 which is in turn supported on the module base 170. The turret assembly 180 is rotatable relative to the turret support 181. The detachable module 118 typically includes a turret assembly 180, a cam body, cams, feeder, tablet discharge chute, and a hopper. Although not shown in detail, the turret assembly 180 comprises chambers arranged circumferentially to hold upper punches, lower punches, and dies. As the turret assembly 180 rotates, punches follow a cam track and reciprocate into and out of dies that receive granulation as they are rotated under the feeder, as is conventional.

In accordance with the invention, the turret assembly 180 is driven by an inlet coupling 182 engageable by the drive shaft 164, see FIG. 11, for driving the turret assembly 180 from above. A powder inlet 184 is provided in the top wall 176 for providing granulated powder to a feeder assembly 186. The feeder assembly 186 is driven by a feeder motor, not shown, to feed powder to the dies. A tablet take-off (not shown) guides the tablet as it is ejected from the die into a discharge chute 187.

Referring to FIG. 14, the module base 170 has a bottom wall 188 with three downwardly depending studs 189. The studs 189 are aligned to be selectively received in corresponding female stud plates (not shown) incident to the detachable module 118 being positioned proximate the base assembly 116. This may be done with a forklift or the like to lower the turret module 118 onto the base assembly bottom wall 130 with the studs 189 received in the stud plates. Other structure not shown is used to secure the turret module 118 to the base assembly 116 and to seal and isolate the turret housing 172 from the exterior. With the module 118 positioned with the base assembly 116, as shown in FIG. 11, the rollers 140, 142, 144 and 146, are positioned relative to the module 118 to engage the turret assembly 180 and contact punches, not shown, to compress the granulated powder to form a tablet, in a conventional manner.

FIGS. 15-18 illustrate a rotary tablet press 210 in accordance with another embodiment of the invention is illustrated. The rotary tablet press 210 is of a similar configuration to that of FIG. 11. For simplicity, the reference numerals in this embodiment correspond to those in the embodiment of FIG. 11 except for being in the two hundred series. The rotary tablet press 210 is configured to produce a trilayer tablet as it has three feeders, as discussed below. As discussed above, a single sided press has only one feeder, and it is designed to make a single layer tablet. It is designed with two equal size compression assemblies for pre-compression and main compression. A triple sided press has three feeders, and it is designed to make a triple layer containing three different granulations. It is conventionally designed with one large compression assembly for main compression and two smaller compression assemblies for the 1st and 2nd layer tamping force. Due to the requirement to use more of the turret circumference for the three feeders and corresponding cam tracks, the disclosed embodiment uses only the main compression assembly. As is apparent, alternative designs could include the two smaller compression assemblies.

Figure 16:
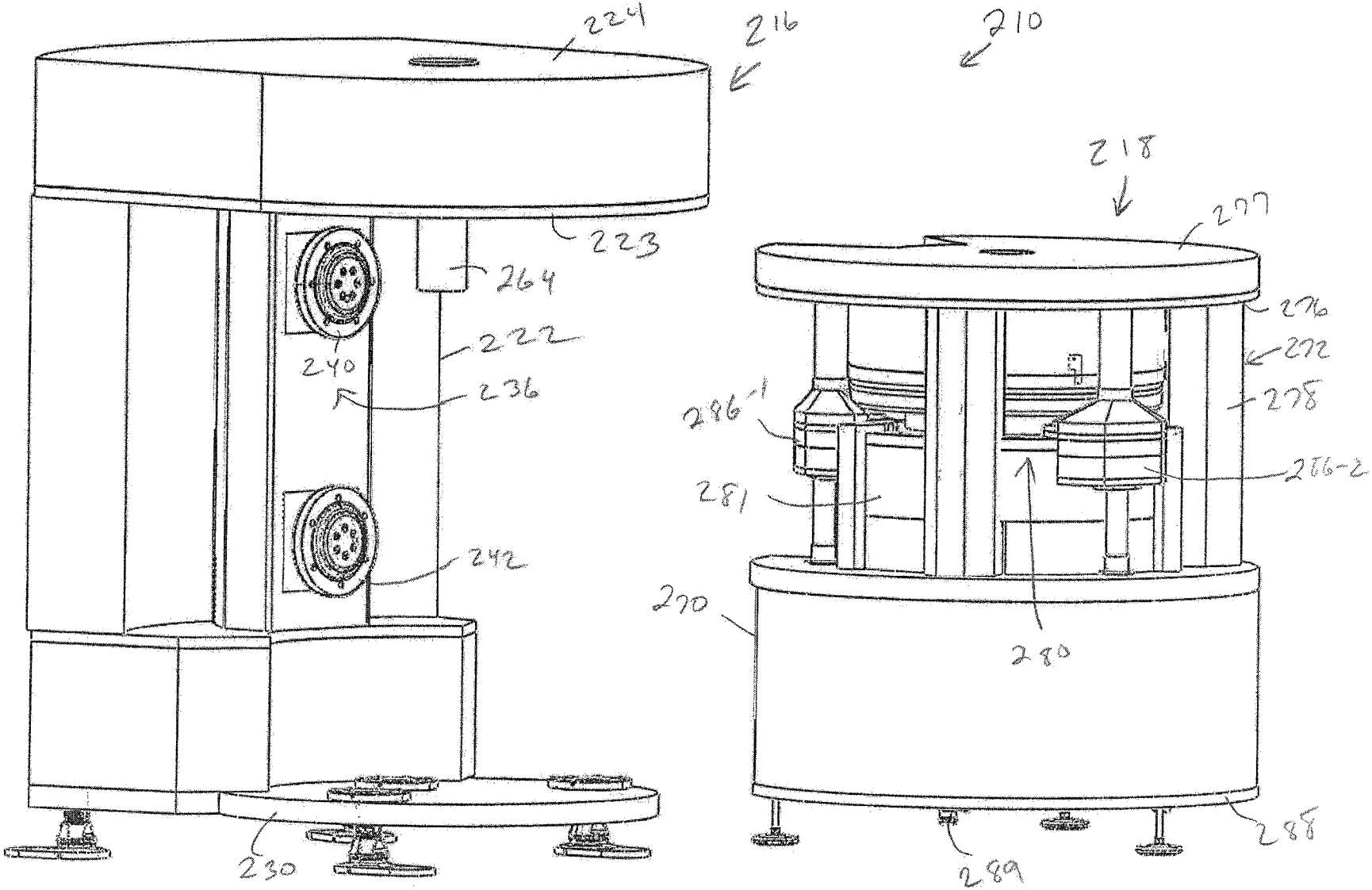
FIG. 16 is a perspective view of the turret module of FIG. 15 separated from the base assembly.

The press 210 comprises a base assembly 216 and a removeable/detachable module 218, see also FIG. 16. The base assembly 216 includes space for control components and operator displays, none of which are shown and do not themselves form part of the invention. FIG. 16 illustrates the turret module 218 separated from the base assembly 216.

Figure 17:
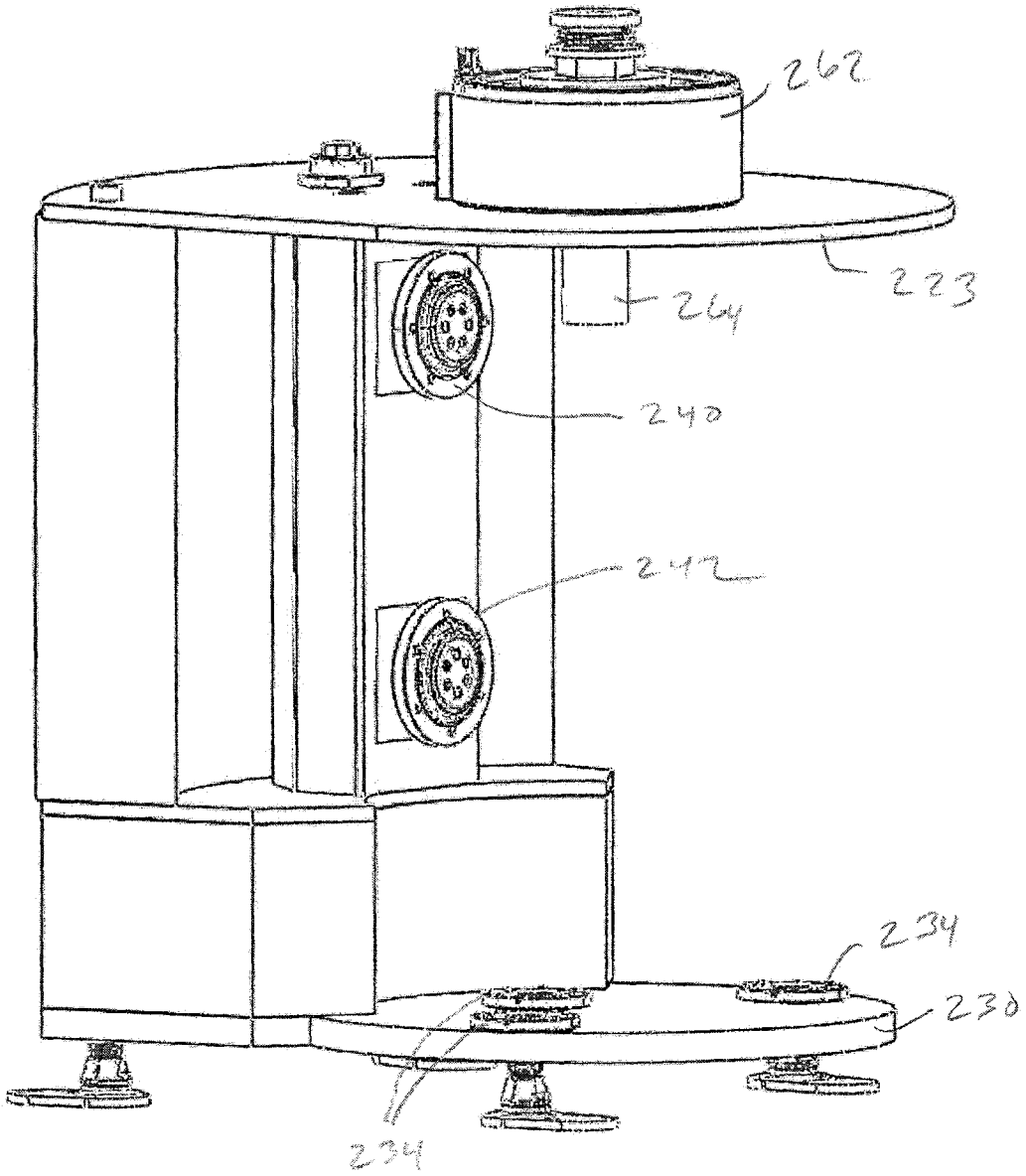
FIG. 17 is a perspective view of the base assembly of FIG. 15.

Referring to FIGS. 16 and 17, the base assembly 216 comprises an arcuate shaped press housing 222. A top wall 223 is at the top of the press housing 222. A top cover 224 overlays the top wall 223. A generally semi-circular bottom wall 230 extends forwardly of the bottom of the press housing 222 and is aligned with the top wall 223. The bottom wall 130 includes three female stud plates 234 for mounting the turret module, as above.

The press housing 222 includes a motorized pressure roll assembly within the housing 222 as well as rails and mounting structure details of which are not shown. Reference may be made to the embodiment of FIG. 3 for such elements. A roller assembly 236 has an upper roller 240 and a lower roller 242.

The top wall 223 is mounted atop the press housing 222 and is of a shape corresponding to the cover 224, discussed above. The top wall 223 supports a turret drive torque motor 262 which drives a downwardly depending drive shaft 264. The motor 262 is also configured to raise and lower the drive shaft 264 to engage a turret for rotation therewith.

Figure 15:
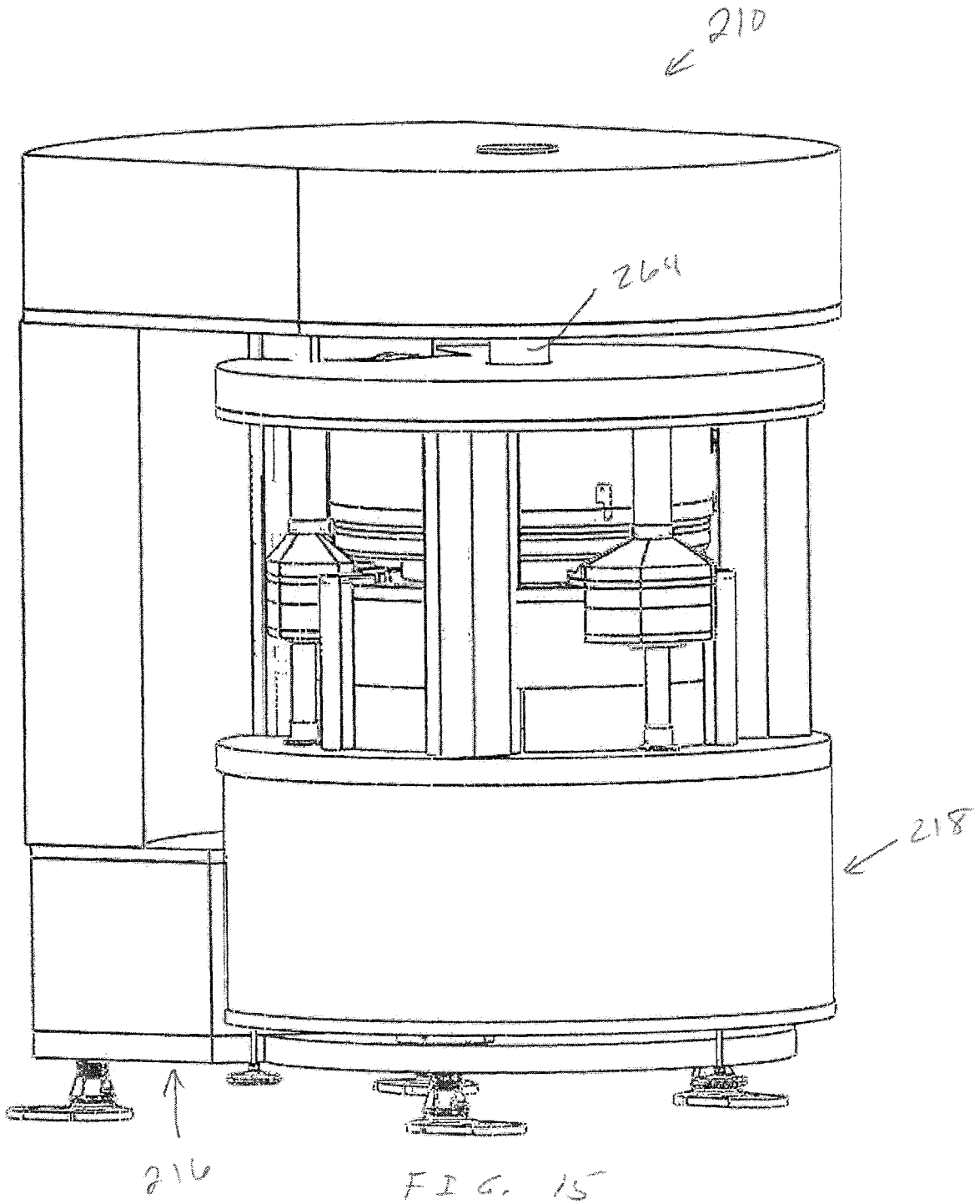
FIG. 15 is a perspective view of a rotary tablet press machine in accordance with a third embodiment of the invention comprising a base assembly and detachable turret module.
Figure 18:
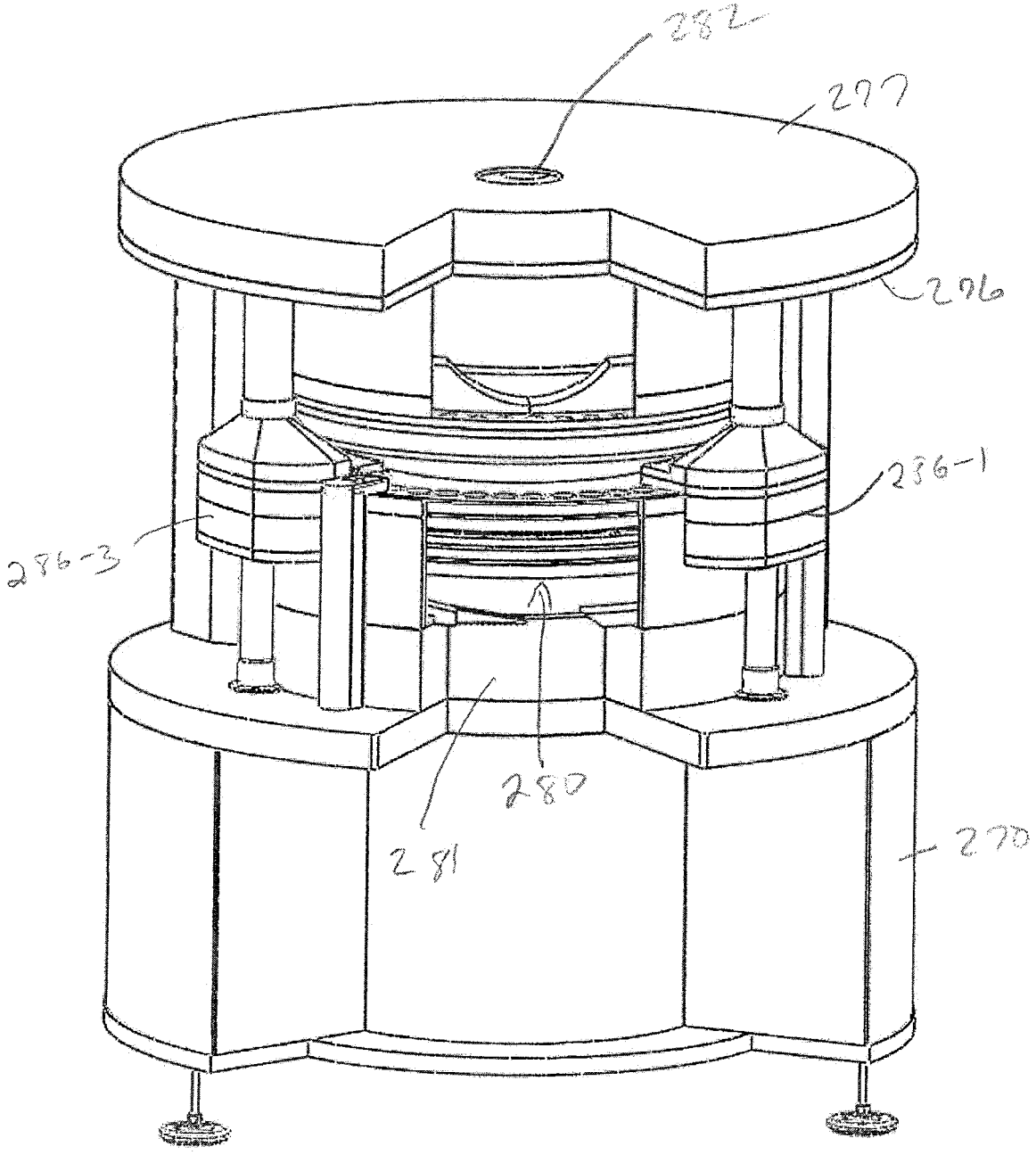
FIG. 18 is a rear perspective view of the turret module of FIG. 15.

Referring to FIGS. 16 and 18, the detachable module 218 is of a generally semi-circular shape, adapted to be received in the base assembly 216 in FIG. 15 to provide a generally cylindrical configuration surrounded by a partial peripheral extension, as shown.

The module 218 comprises a module base 270 supporting a turret housing 272. The turret housing 272 has a top wall 276 supported on pillars 278 which are in turn supported on the module base 270. A cover 277 is provided on the top wall to provide space for additional components. A transparent outer wall (not shown in this embodiment) surrounds the front of the turret housing 272 to isolate the internal assemblies.

The turret housing 272 encloses a turret assembly 280, as above. The turret assembly 280 is mounted to a support 281 which is in turn supported on the module base 270. The turret assembly 280 is rotatable relative to the support 281. The turret module 218 typically includes the turret assembly 280, a cam body, cams, feeder, tablet discharge chute, and a hopper. Although not shown in detail, the turret assembly 280 comprises chambers arranged circumferentially to hold upper punches, lower punches, and dies. As the turret module 280 rotates, punches follow a cam track and reciprocate into and out of dies that receive granulation as they are rotated under the feeder, as is conventional.

In accordance with the invention, the turret assembly 280 is driven by an inlet coupling 282 engageable by the drive shaft 264, see FIG. 15, for driving the turret assembly 280 from above. Powder inlets (not shown) provide granulated powder to three feeder assemblies 286-1, 286-2 and 186-3. The feeder assemblies are driven by feeder motors, not shown, to feed three different powders to the dies to make a trilayer tablet.

Referring to FIG. 16, the module base 270 has a bottom wall 288 with three downwardly depending studs 289, one of which is shown. The studs 289 are aligned to be selectively received in corresponding female stud plates 234 incident to the detachable module 218 being positioned proximate the base assembly 216. This may be done with a forklift or the like to lower the turret module 218 onto the base assembly bottom wall 230 with the studs 289 received in the stud plates 234. Other structure not shown is used to secure the turret module 218 to the base assembly 216 and to seal and isolate the turret housing 272 from the exterior. With the module 218 positioned with the base assembly 216, as shown in FIG. 15, the rollers 240 and 242, are positioned relative to the module 218 to engage the turret assembly 280 and contact punches, not shown, to compress the granulated powder to form a tablet, in a conventional manner.

Figure 19:
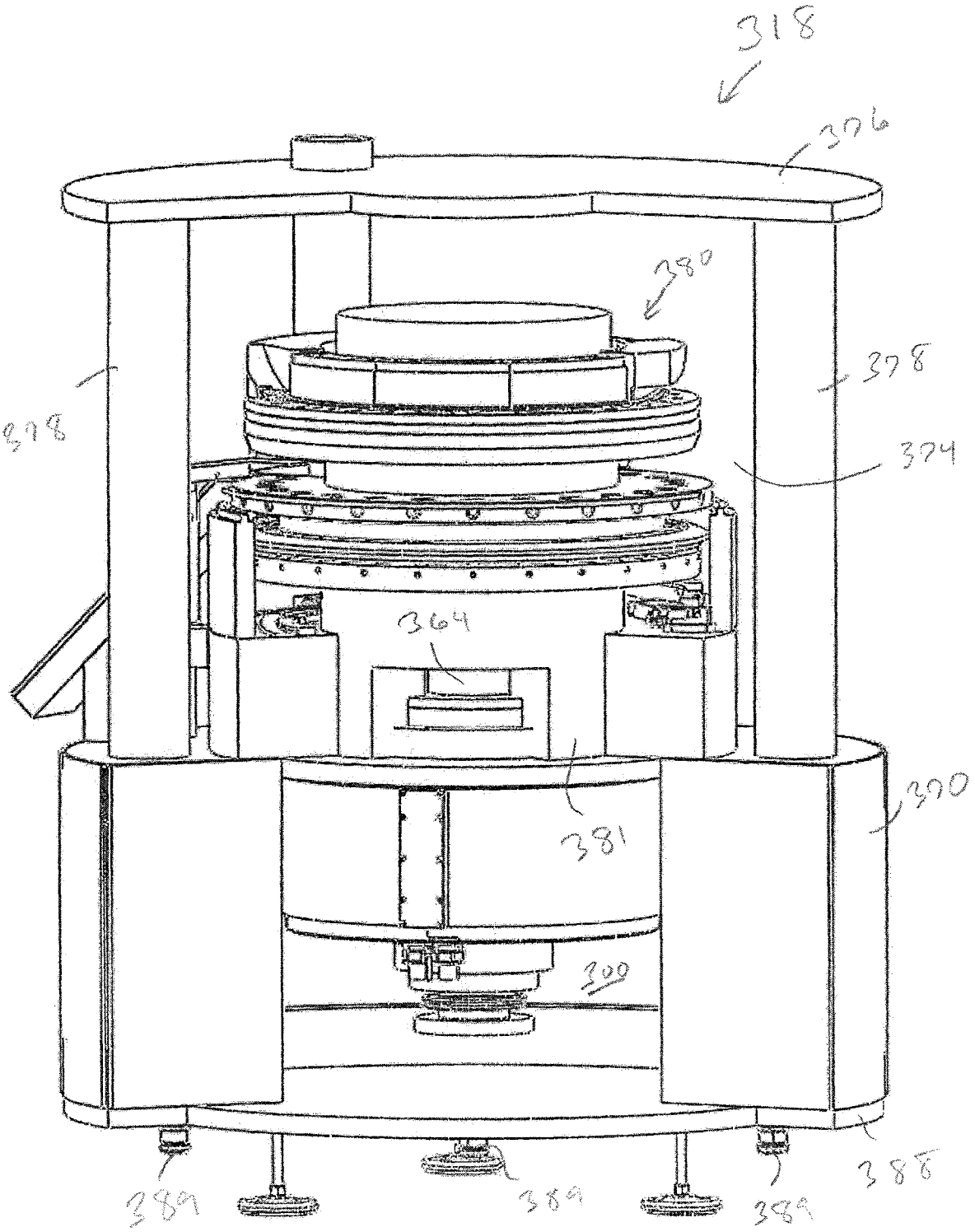
FIG. 19 is a rear perspective view of a turret module similar to that in FIG. 14 with a bottom mount motor drive.
Figure 20:
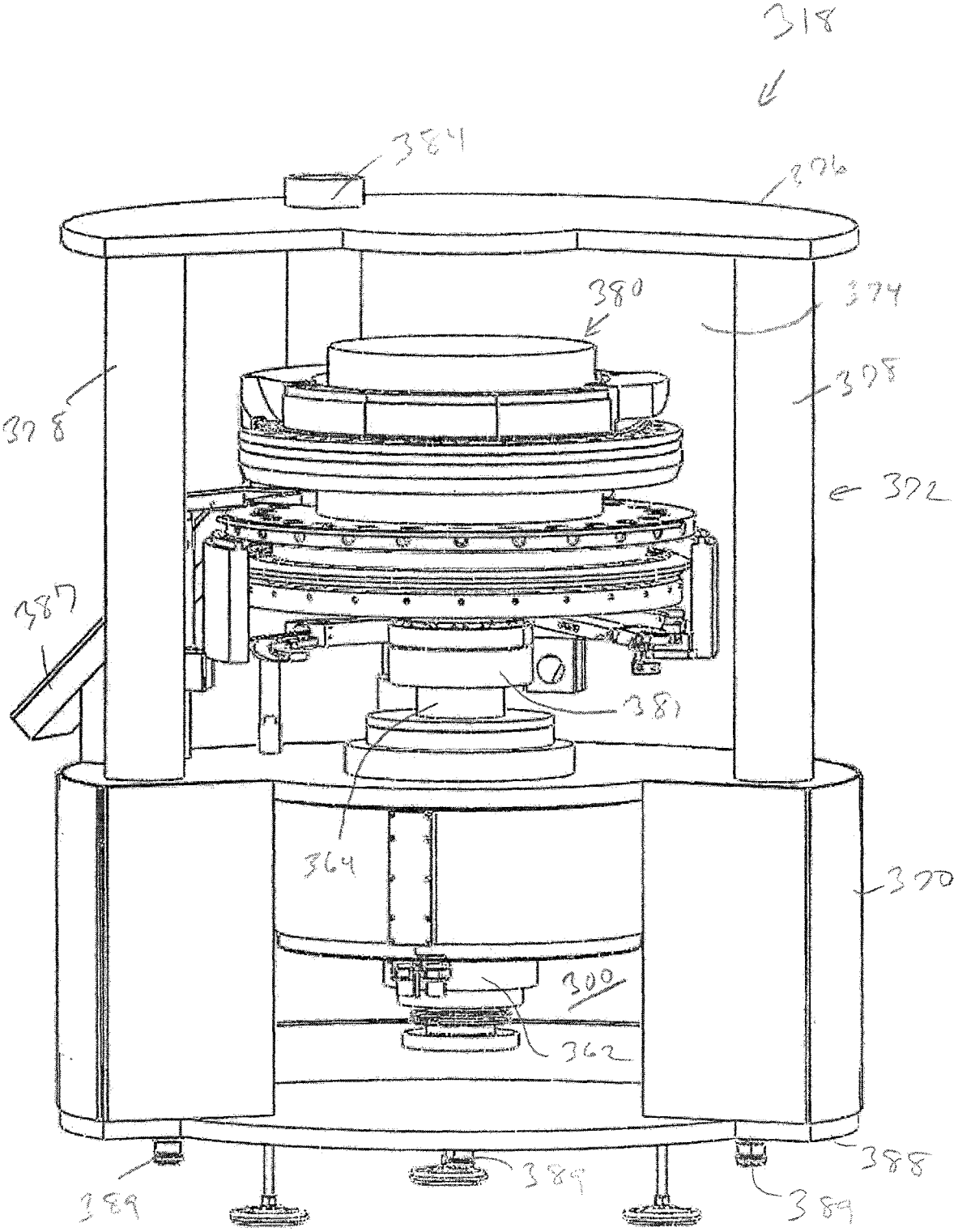
FIG. 20 is a rear perspective view of the turret module of FIG. 19 with a turret base removed.

FIGS. 19 and 20 illustrate a turret module 318 in accordance with an alternative embodiment. In the previously discussed embodiments, the turret drive motor is located in the base assembly and drives the turret from above. In the embodiment of FIGS. 19 and 20, the turret is driven by a bottom mounted motor in a conventional manner.

The detachable module 318 is of a generally semi-circular shape, adapted to be received in the base assembly 116 in FIG. 11 (without the top mounted drive motor 162) to provide a generally cylindrical configuration surrounded by a partial peripheral extension, as shown.

The module 318 comprises a module base 370 supporting a turret housing 372. The turret housing 372 has a top wall 376 supported on pillars 378 which are in turn supported on the module base 370. A transparent outer wall 374 surrounds the front of the turret housing 372 to isolate the internal assemblies. The outer wall 374 may be of a clear polycarbonate material. When the detachable module 318 is secured to the base assembly 116, the detachable module 318 is sealed by incorporating an upper enclosure via the outer wall 374. The back of the turret housing 372 is open to allow the pressure roll assemblies 136 and 138 to engage the turret, as described previously.

The turret housing 372 encloses a turret assembly 380, as above. The turret assembly 380 is mounted to a turret support 381 which is in turn supported on the module base 370. The turret support 381 is removed in FIG. 20 to illustrate the drive connection. The turret assembly 380 is rotatable relative to the turret support 381. The turret assembly 380 typically includes a die assembly, cam body, cams, feeder, tablet discharge chute, and a hopper. Although not shown in detail, the die assembly comprises chambers arranged circumferentially to hold upper punches, lower punches, and dies. As the turret module 380 rotates, punches follow a cam track and reciprocate into and out of dies that receive granulation as they are rotated under the feeder, as is conventional.

In accordance with the invention, the module base 380 includes an interior space 300. A turret drive torque motor 362 which drives a upwardly extending drive shaft 264 is mounted in the interior space 300. The turret assembly 380 is driven by an inlet coupling 382 engageable by the drive shaft 364 for driving the turret assembly 380 from below. A powder inlet 384 is provided in the top wall 376 for providing granulated powder to a feeder assembly (not shown). A tablet take-off (not shown) guides the tablet as it is ejected from the die into a discharge chute 387.

The module base 370 has a bottom wall 388 with three downwardly depending studs 389. The studs 389 are aligned to be selectively received in corresponding female stud plates incident to the detachable module 318 being positioned proximate the base assembly 116. This may be done with a forklift or the like to lower the turret module 318 onto the base assembly bottom wall 130 with the studs 389 received in the stud plates. Other structure not shown is used to secure the turret module 318 to the base assembly 116 and to seal and isolate the turret housing 372 from the exterior. With the module 318 positioned with the base assembly 116 the rollers 140, 142, 144 and 146, are positioned relative to the module 318 to engage the turret assembly 380 and contact punches, not shown, to compress the granulated powder to form a tablet, in a conventional manner.

As described in the illustrated embodiments, a rotary tablet press comprises a machine base assembly and detachable module. Granulation is fed into the module from a hopper and travels into the feeder chamber. The base assembly comprises motorized pressure roll assemblies and a turret drive assembly. The detachable module comprises a module base, turret base, turret, cam body, cams, feeder, tablet discharge chute, hopper, upper enclosure, and guard doors. The rotary turret comprises upper punches, dies, and lower punches. As the turret rotates, the dies move underneath the feeder chamber. The rotary feeder paddles move the granulation and assist with feeding powder to the dies. Punches travel along cam tracks as the turret rotates and compresses the powder into a tablet when the punches contact the pressure rolls. An ejection cam pushes the lower punch in the upward direction and a take-off bar mounted just above the die table directs the tablet into a discharge chute. The detachable module is sealed by incorporating an upper enclosure.

It will be appreciated by those skilled in the art that there are many possible modifications to be made to the specific forms of the features and components of the disclosed embodiments while keeping within the spirit of the concepts disclosed herein. Accordingly, no limitations to the specific forms of the embodiments disclosed herein should be read into the claims unless expressly recited in the claims. Although a few embodiments have been described in detail above, other modifications are possible. Other embodiments may be within the scope of the following claims.

The foregoing disclosure of specific embodiments is intended to be illustrative of the broad concepts comprehended by the invention.

The invention claimed is:

1. A rotary tablet press comprising:

a base assembly comprising a press housing and a compression assembly in the press housing including pressure roll assemblies;

a detachable module removably mountable to the base assembly comprising a module base supporting a turret housing, a turret assembly rotatably mounted in the turret housing about a vertical axis, the turret assembly comprising a plurality of die stations, the detachable module being selectively positioned at the base assembly so that the pressure roll assemblies engage the turret assembly to compress a granulation into a tablet at the die stations; and a turret drive assembly comprising a turret motor and drive shaft, the drive shaft being aligned with the vertical axis and engaging the turret assembly to rotate the turret assembly.

2. The rotary tablet press of claim 1 wherein the turret drive assembly is mounted at a top of the press housing.

3. The rotary tablet press of claim 2 wherein the press housing comprises a drive housing extending outwardly from a top end of the press housing and the drive shaft extends downward from a turret motor.

4. The rotary tablet press of claim 1 wherein the turret drive assembly is mounted in the module base.

5. The rotary tablet press of claim 1 wherein the turret assembly comprises a plurality of dies and associated top and bottom punches driven by top and bottom cams to compress a granulation into a tablet.

6. The rotary tablet press of claim 1 wherein the detachable module comprises a feeder.

7. The rotary tablet press of claim 1 wherein the detachable module comprises a plurality of feeders.

8. The rotary tablet press of claim 1 wherein the pressure roll assemblies comprise motorized pressure roll assemblies.

9. The rotary tablet press of claim 1 wherein the turret assembly is configured to produce a single tablet product.

10. The rotary tablet press of claim 1 wherein the turret assembly is configured to produce two tablet products.

11. The rotary tablet press of claim 1 wherein the turret assembly is configured to produce a bilayer tablet product.

12. The rotary tablet press of claim 1 wherein the turret assembly is configured to produce a trilayer tablet product.

13. The rotary tablet press of claim 1 wherein the compression assembly comprises an upper roller and a lower roller.

14. The rotary tablet press of claim 1 wherein the compression assembly comprises first and second pressure roll assemblies each having an upper roller and a lower roller.

15. A rotary tablet press comprising:

a press housing having bottom and top ends, the bottom for resting on a support surface;

a compression assembly in the press housing and including pressure roll assemblies;

a drive housing extending outwardly from the top end of the press housing;

a drive assembly enclosed in the drive housing and comprising a turret motor directly driving a drive shaft extending downward from the turret motor; and a turret assembly comprising a plurality of die stations, the turret assembly being mounted to the press housing below the drive housing and about a vertical axis so that the pressure roll assemblies engage the turret assembly to compress a granulation into a tablet at the die stations, the drive shaft being aligned with the vertical axis and engaging the turret assembly to rotate the turret assembly.

16. The rotary tablet press of claim 15 wherein the turret motor is configured to raise and lower the drive shaft to engage the turret assembly for rotation therewith.

17. A rotary tablet press comprising:

a press housing having bottom and top ends, the bottom for resting on a support surface;

a compression assembly in the press housing and including pressure roll assemblies;

a drive housing extending outwardly from the top end of the press housing;

a drive assembly in the drive housing comprising a turret motor and drive shaft extending downward from the turret motor; and a turret assembly comprising a plurality of die stations, the turret assembly being mounted to the press housing about a vertical axis so that the pressure roll assemblies engage the turret assembly to compress a granulation into a tablet at the die stations, the drive shaft being aligned with the vertical axis and engaging the turret assembly to rotate the turret assembly, further comprising a detachable module removably mountable to the press housing and comprising a module base supporting a turret housing, the turret assembly being rotatably mounted in in the turret housing.

18. The rotary tablet press of claim 17 wherein the detachable module comprises a feeder.

19. The rotary tablet press of claim 17 wherein the detachable module comprises a plurality of feeders.

20. The rotary tablet press of claim 15 wherein the turret assembly comprises a plurality of dies and associated top and bottom punches driven by top and bottom cams to compress a granulation into a tablet.

* * * * *